US008892428B2

(12) United States Patent
Oshikiri

(10) Patent No.: US 8,892,428 B2
(45) Date of Patent: Nov. 18, 2014

(54) ENCODING APPARATUS, DECODING APPARATUS, ENCODING METHOD, AND DECODING METHOD FOR ADJUSTING A SPECTRUM AMPLITUDE

(75) Inventor: Masahiro Oshikiri, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 254 days.

(21) Appl. No.: 13/521,341

(22) PCT Filed: Jan. 13, 2011

(86) PCT No.: PCT/JP2011/000133

§ 371 (c)(1),
(2), (4) Date: Jul. 10, 2012

(87) PCT Pub. No.: WO2011/086923

PCT Pub. Date: Jul. 21, 2011

(65) Prior Publication Data

US 2012/0296659 A1 Nov. 22, 2012

(30) Foreign Application Priority Data

Jan. 14, 2010 (JP) ..... 2010-006260

(51) Int. Cl.

| | |
|---|---|
| ***G10L 19/26*** | (2013.01) |
| ***G10L 19/24*** | (2013.01) |
| ***G10L 19/12*** | (2013.01) |
| *G10L 19/02* | (2013.01) |

(52) U.S. Cl.

CPC ..... *G10L 19/12* (2013.01); *G10L 19/24* (2013.01); *G10L 19/0212* (2013.01); *G10L 19/26* (2013.01)

USPC ..... 704/219

(58) Field of Classification Search

CPC ..... G10L 19/0212; G10L 19/12; G10L 19/22

USPC ..... 704/219–221

See application file for complete search history.

(56) References Cited

U.S. PATENT DOCUMENTS

| | | | |
|---|---|---|---|
| 6,260,009 | B1 | 7/2001 | Dejaco |
| 7,251,596 | B2 | 7/2007 | Zhu et al. |

(Continued)

FOREIGN PATENT DOCUMENTS

| | | |
|---|---|---|
| CN | 1347550 | 5/2002 |
| CN | 1430204 | 7/2003 |

(Continued)

OTHER PUBLICATIONS

M. R. Schroeder and B.S. Atal, "Code-Excited Linear Prediction (CELP): High-Quality Speech At Very Low Bit Rates", Proc. ICASSP 85, 1985, pp. 937-940.

(Continued)

*Primary Examiner* — Michael N Opsasnick

(74) *Attorney, Agent, or Firm* — Greenblum & Bernstein, P.L.C.

(57) ABSTRACT

An encoding device is provided for increasing the quality of an encoded signal, even when encoding music signals. In the encoding device, a Code-Excited Linear Prediction (CELP) encoder generates first encoded data by encoding an input signal, and a CELP decoder generates a decoded signal by decoding the first encoded data input from the CELP encoder. Additionally, a characteristic parameter encoder calculates a parameter that expresses the degree of fluctuation in the ratio of the peak components and the floor components between the spectra of the decoded signal and the input signal.

6 Claims, 16 Drawing Sheets

(56) References Cited

U.S. PATENT DOCUMENTS

| | | | | |
|---|---|---|---|---|
| 2001/0016817 | A1 | 8/2001 | Dejaco | |
| 2003/0171917 | A1 | 9/2003 | Zhu et al. | |
| 2003/0204543 | A1 | 10/2003 | Yoon et al. | |
| 2004/0019492 | A1* | 1/2004 | Tucker et al. | 704/500 |
| 2005/0163323 | A1* | 7/2005 | Oshikiri | 381/22 |
| 2007/0147518 | A1* | 6/2007 | Bessette | 375/243 |
| 2008/0027711 | A1* | 1/2008 | Rajendran et al. | 704/201 |
| 2008/0052068 | A1* | 2/2008 | Aguilar et al. | 704/230 |
| 2010/0063803 | A1* | 3/2010 | Gao | 704/205 |
| 2010/0070269 | A1* | 3/2010 | Gao | 704/207 |
| 2010/0070270 | A1* | 3/2010 | Gao | 704/207 |
| 2010/0274558 | A1 | 10/2010 | Yamanashi et al. | |
| 2010/0280833 | A1 | 11/2010 | Yamanashi et al. | |
| 2011/0035213 | A1 | 2/2011 | Malenovsky et al. | |

FOREIGN PATENT DOCUMENTS

| | | |
|---|---|---|
| CN | 1455390 | 11/2003 |
| JP | 2002-099300 | 4/2002 |
| JP | 2002-123298 | 4/2002 |
| WO | 2009/000073 | 12/2008 |
| WO | 2009/081568 | 7/2009 |
| WO | 2009/084221 | 7/2009 |
| WO | 2010/077557 | 7/2010 |

OTHER PUBLICATIONS

Tommy Vaillancourt et al., "Inter-Tone Noise Reduction in A Low Bit Rate CELP Decoder", Proc. ICASSP 2009, 2009, pp. 4113-4116.

Masahiro Oshikiri et al., "Improvement of the Super-Wideband Scalable Coder Using Pitch Filtering Based Spectrum Coding", Report of the 2004 Autumn Meeting, The Acoustical Society of Japan—I—, Sep. 21, 2004, pp. 297-298, (with English language translation).

International Search Report, mailed Apr. 12, 2011, for corresponding International Application No. PCT/JP2011/000133, (with English language translation).

China Search Report (English Language Translation) annexed to China Office action, dated Sep. 3, 2014.

* cited by examiner

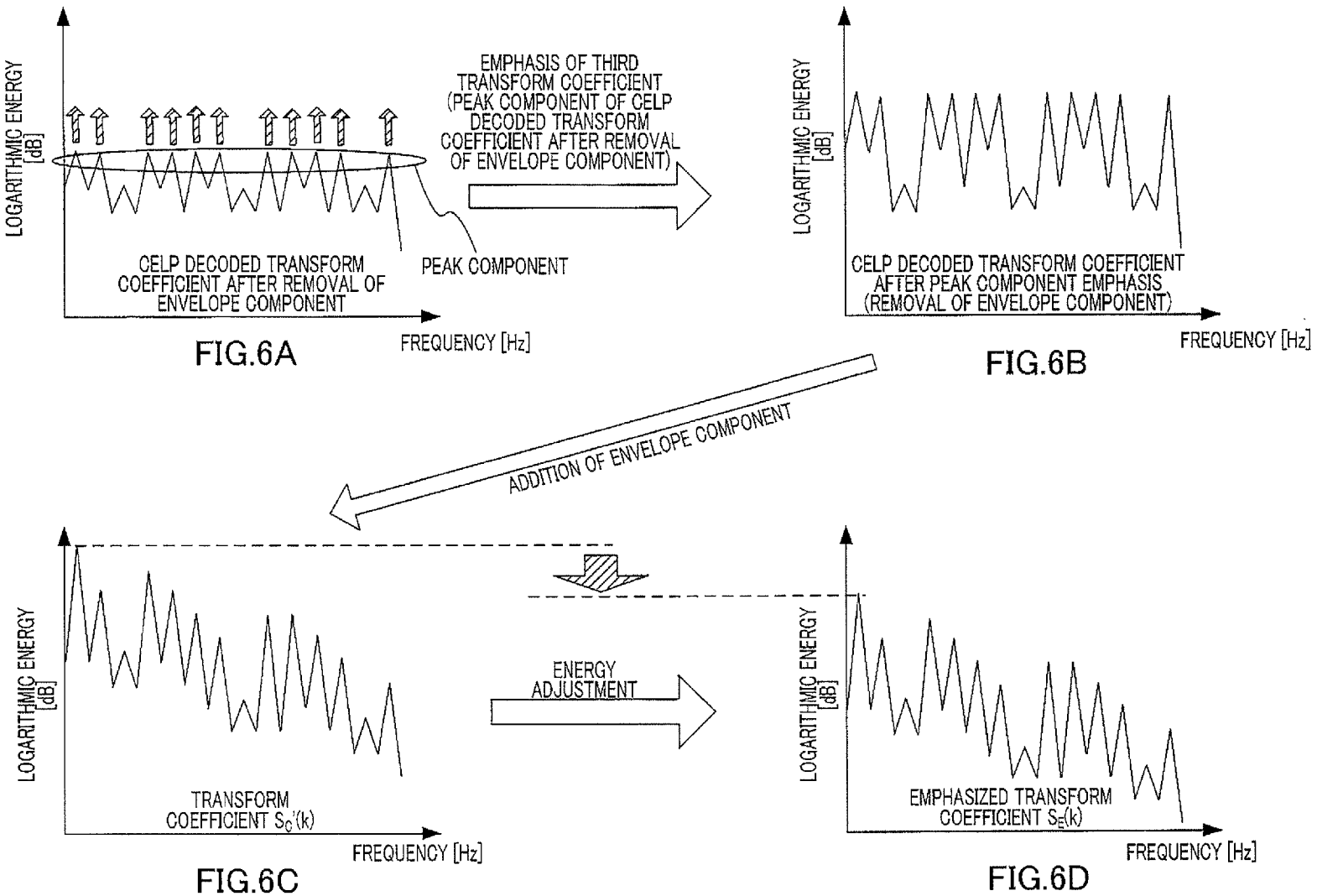
LOGARITHMIC ENERGY [dB]
CELP DECODED TRANSFORM COEFFICIENT AFTER PEAK COMPONENT EMPHASIS (REMOVAL OF ENVELOPE COMPONENT)
FREQUENCY [Hz]
FIG.6B
EMPHASIS OF THIRD TRANSFORM COEFFICIENT (PEAK COMPONENT OF CELP DECODED TRANSFORM COEFFICIENT AFTER REMOVAL OF ENVELOPE COMPONENT)
PEAK COMPONENT
CELP DECODED TRANSFORM COEFFICIENT AFTER REMOVAL OF ENVELOPE COMPONENT
FREQUENCY [Hz]
FIG.6A
ADDITION OF ENVELOPE COMPONENT
LOGARITHMIC ENERGY [dB]
EMPHASIZED TRANSFORM COEFFICIENT $S_E(k)$
FREQUENCY [Hz]
FIG.6D
ENERGY ADJUSTMENT
LOGARITHMIC ENERGY [dB]
TRANSFORM COEFFICIENT $S_C'(k)$
FREQUENCY [Hz]
FIG.6C

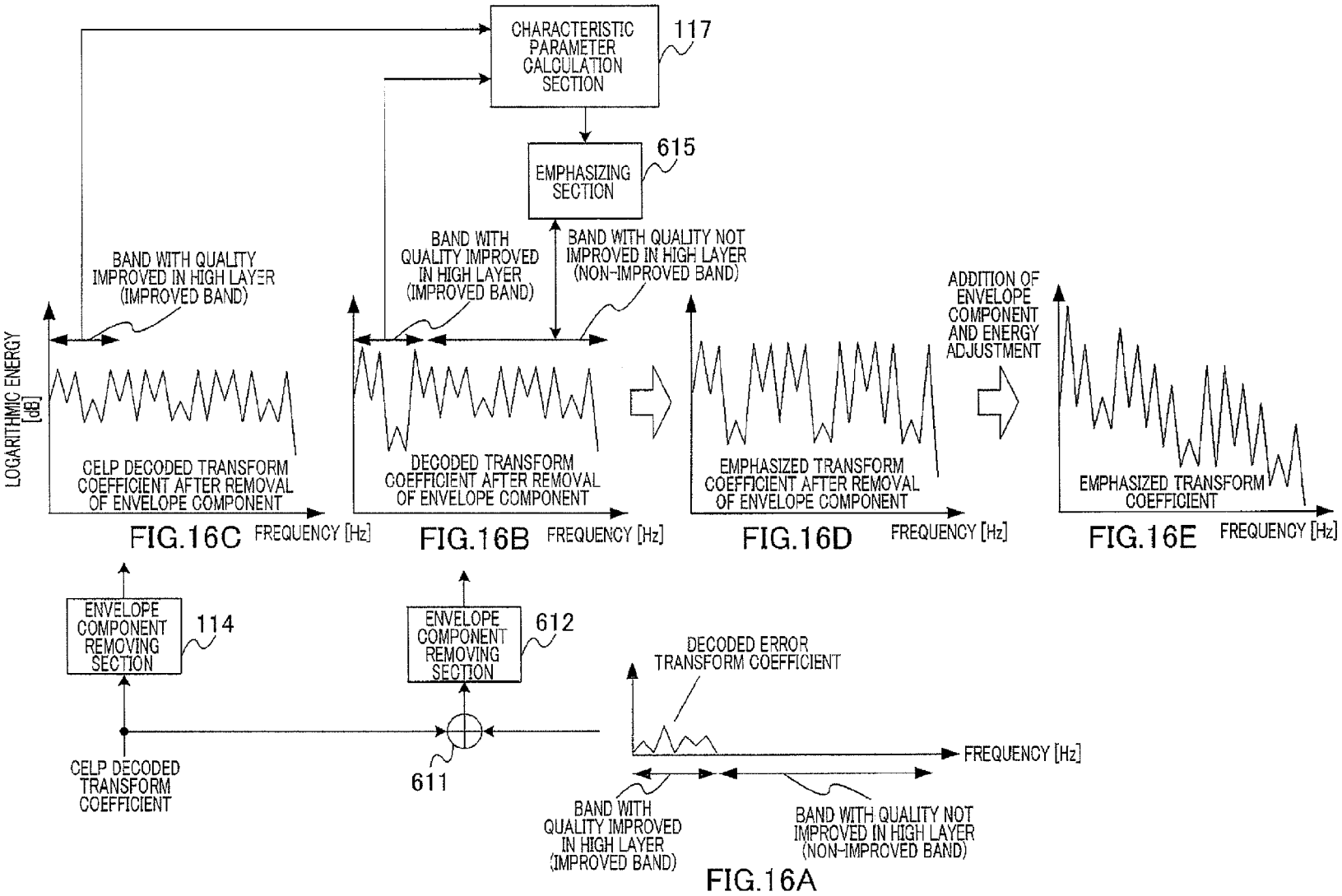
CHARACTERISTIC PARAMETER CALCULATION SECTION
117
EMPHASIZING SECTION
615
BAND WITH QUALITY NOT IMPROVED IN HIGH LAYER (NON-IMPROVED BAND)
BAND WITH QUALITY IMPROVED IN HIGH LAYER (IMPROVED BAND)
BAND WITH QUALITY IMPROVED IN HIGH LAYER (IMPROVED BAND)
CELP DECODED TRANSFORM COEFFICIENT AFTER REMOVAL OF ENVELOPE COMPONENT
FIG.16C
FREQUENCY [Hz]
DECODED TRANSFORM COEFFICIENT AFTER REMOVAL OF ENVELOPE COMPONENT
FIG.16B
FREQUENCY [Hz]
EMPHASIZED TRANSFORM COEFFICIENT AFTER REMOVAL OF ENVELOPE COMPONENT
FIG.16D
FREQUENCY [Hz]
ADDITION OF ENVELOPE COMPONENT AND ENERGY ADJUSTMENT
EMPHASIZED TRANSFORM COEFFICIENT
FIG.16E
FREQUENCY [Hz]
LOGARITHMIC ENERGY [dB]
ENVELOPE COMPONENT REMOVING SECTION
114
ENVELOPE COMPONENT REMOVING SECTION
612
611
CELP DECODED TRANSFORM COEFFICIENT
DECODED ERROR TRANSFORM COEFFICIENT
FREQUENCY [Hz]
BAND WITH QUALITY NOT IMPROVED IN HIGH LAYER (NON-IMPROVED BAND)
BAND WITH QUALITY IMPROVED IN HIGH LAYER (IMPROVED BAND)
FIG.16A

ENCODING APPARATUS, DECODING APPARATUS, ENCODING METHOD, AND DECODING METHOD FOR ADJUSTING A SPECTRUM AMPLITUDE

TECHNICAL FIELD

The present invention relates to an encoding apparatus, a decoding apparatus, a spectrum fluctuation calculation method and a spectrum amplitude adjustment method.

BACKGROUND ART

For effective utilization of radio wave resources or the like, mobile communication systems require a technique of compressing a speech signal to a low bit rate and transmitting the signal. On the other hand, speech codec capable of encoding signals at a low bit rate and with high quality is required for not only speech signals but also signals other than speech signals such as music signals. This is a technique indispensable for realizing high quality in a service of streaming music (melody call or the like) as a ringing back tone, for example.

CELP (Code Excited Linear Prediction) encoding is an effective scheme that encodes a speech signal at a low bit rate with high efficiency (e.g., see Non-Patent Literature 1). CELP encoding is a scheme that causes an excitation signal recorded in a codebook to pass through a pitch filter corresponding to the strength of periodicity and a synthesis filter corresponding to a vocal tract characteristic and determines encoding parameters so that a square error between output and input signals thereof is minimized under a weight of perceptual characteristics based on an engineering simulation model of a human speech generation model. In CELP encoding, using this model allows a speech signal to be encoded at a low bit rate and with high sound quality. Many of latest standard speech encoding schemes are based on CELP encoding and typical examples thereof include G729, G718 of ITU (International Telecommunication Union or AMR, AMR-WB of 3GPP (The 3rd Generation Partnership Project).

CITATION LIST

Non-Patent Literature

NPL 1

M. R. Schoder and B. S. Atal, "Code-excited linear prediction (CELP); high-quality speech at very low bit rates", Proc. ICASSP 85, pp. 937-940, 1985.

SUMMARY OF INVENTION

Technical Problem

However, CELP encoding is a speech codec capable of encoding a speech signal at a low bit rate and with high sound quality, but since CELP encoding is based on a model not suitable for a music signal, applying CELP encoding to a music signal causes sound quality to considerably degrade.

To be more specific, as described above, CELP encoding causes an excitation signal recorded in a codebook to pass through a pitch filter corresponding to the strength of periodicity and a synthesis filter corresponding to a vocal tract characteristic and generates a synthesis signal. This model is suitable for expressing a high energy component (spectrum envelope) at a resonance frequency corresponding to a formant of a speech signal and a component with relatively strong peak performance appearing at an integer multiple of a fundamental frequency (harmonic structure or harmonics). However, a formant or harmonic structure in the speech signal does not always exist in a general music signal. Moreover, components having much stronger peak performance than the harmonic structure of the speech signal appear in the music signal, whereas CELP encoding cannot express such components with accuracy.

For example, FIG. 1A and FIG. 1B show a spectrum resulting from frequency-analyzing a signal which is a vowel part of a speech signal recorded at a sampling rate of 16 kHz (original signal spectrum (speech) shown in FIG. 1A) and a spectrum of decoded sound resulting from processing the signal in an 8 kbit/s mode of ITU-T G718 (decoded signal spectrum (speech) shown in FIG. 1B). The 8 kbit/s mode of G718 is an encoding scheme based on CELP encoding. It is clear from a comparison between the original signal spectrum shown in FIG. 1A and the decoded signal spectrum shown in FIG. 1B that the two spectra are generally very similar to each other although there is a minor difference in a high frequency region.

On the other hand, FIG. 1C and FIG. 1D show a spectrum resulting from frequency-analyzing a piano sound (music signal) recorded at a sampling rate of 16 kHz (original signal spectrum (piano) shown in FIG. 1C) and a spectrum of a decoded sound after processing the signal in an 8 kbit/s mode of ITU-T G718 (decoded signal spectrum (piano) shown in FIG. 1D). A comparison between the original signal spectrum shown in FIG. 1C and the decoded signal spectrum shown in FIG. 1D shows that peak (tone) shapes of the spectrum clearly appear in the entire original signal spectrum. On the other hand, in the decoded signal spectrum, peak shapes of the spectrum start to collapse at approximately 1.5 kHz and the spectrum shape greatly differs from the original signal spectrum at 3.5 kHz or above. Thus, the peak shapes of the decoded signal spectrum collapse and the sizes of crests and troughs of peaks of the spectrum are suppressed, and when a user listens to the decoded signal, the user feels as if he/she were hearing noise and the sound quality is considerably degraded.

Thus, as a technique of improving quality of a decoded signal in CELP encoding, a technique is proposed which frequency-analyzes a decoded signal of CELP encoding, suppresses inter-tone components in subband units and thereby improves sound quality of a music signal (e.g., see Tommy Vaillancourt, et. al., "Inter-tone noise reduction in a low bit rate CELP decoder", Proc. ICASSP2009, pp. 4113-4116, 2009).

However, since this technique determines the amount of suppression of inter-tone components in subband units, there is a problem that the frequency resolution is lowered. Moreover, since this technique frequency-analyzes the decoded signal (that is, the signal of degraded quality) and thereby calculates the amount of suppression of inter-tone components, there is a problem that it is difficult to calculate the accurate amount of suppression to improve sound quality. For these reasons, it is not possible to obtain sufficient sound quality improvement effects.

It is an object of the present invention to provide an encoding apparatus, a decoding apparatus, a spectrum fluctuation calculation method and a spectrum amplitude adjustment method capable of improving quality of a decoded signal even when encoding a music signal.

Solution to Problem

An encoding apparatus according to the present invention adopts a configuration including a first encoding section that encodes an input signal to generate first encoded data, a decoding section that decodes the first encoded data to generate a decoded signal and a calculation section that calculates a parameter indicating the amount of fluctuation in a ratio of peak components and floor components between spectra of the decoded signal and the input signal.

A decoding apparatus according to the present invention adopts a configuration including a first decoding section that decodes first encoded data obtained by encoding an input signal in an encoding apparatus, to generate a decoded signal, and an adjustment section that adjusts amplitude of peak components of a spectrum of the decoded signal using a parameter indicating the amount of fluctuation in a ratio of peak components and floor components between spectra of the decoded signal and the input signal.

A spectrum fluctuation calculation method according to the present invention adopts a configuration including an encoding step of encoding an input signal to generate first encoded data, a decoding step of decoding the first encoded data to generate a decoded signal, and a calculating step of calculating a parameter indicating the amount of fluctuation in a ratio of peak components and floor components between spectra of the decoded signal and the input signal.

A spectrum amplitude adjustment method according to the present invention includes a decoding step of decoding first encoded data obtained by encoding an input signal in an encoding apparatus, to generate a decoded signal, and an adjusting step of adjusting amplitude of peak components of a spectrum of the decoded signal using a parameter indicating the amount of fluctuation in a ratio of peak components and floor components between spectra of the decoded signal and the input signal.

Advantageous Effects of Invention

According to the present invention, it is possible to improve quality of a decoded signal even when encoding a music signal.

BRIEF DESCRIPTION OF DRAWINGS

FIG. 6 are diagrams illustrating a processing flow in the transform coefficient emphasizing section according to Embodiment 1 of the present invention;

FIG. 16 are diagrams illustrating a processing flow of the transform coefficient emphasizing section according to Embodiment 4 of the present invention.

DESCRIPTION OF EMBODIMENTS

Hereinafter, embodiments of the present invention will be described in detail with reference to the accompanying drawings. In the following description, a variable using n (e.g., s(n)) represents a time domain signal and a variable using k (e.g., S(k)) represents a frequency domain signal. Furthermore, a speech signal or music signal is inputted to an encoding apparatus according to the present invention as an input signal.

Embodiment 1

Figure 1A:
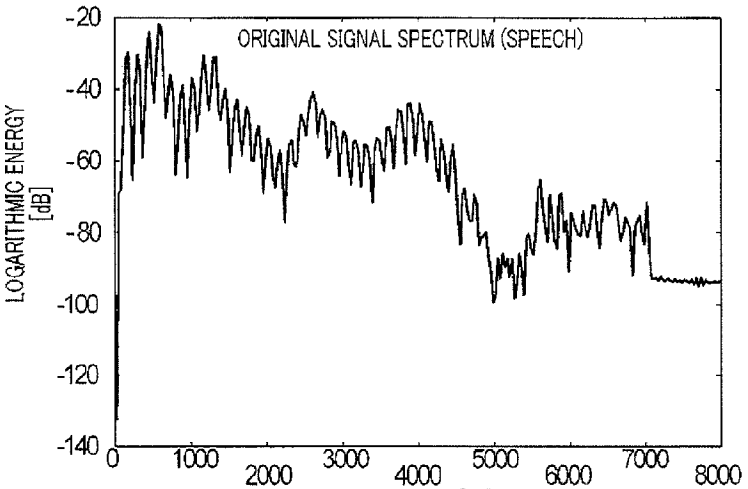
FIG. 1 are diagrams illustrating shapes of an original signal spectrum and a decoded signal spectrum of a speech signal and a music signal.
Figure 1B:
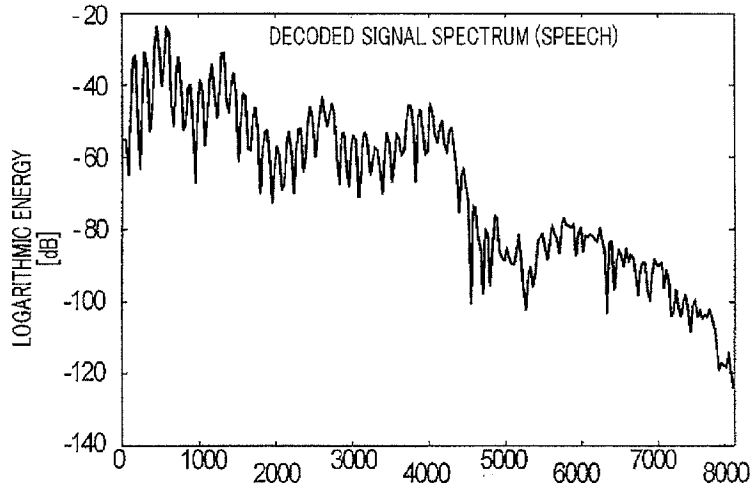
Figure 1C:
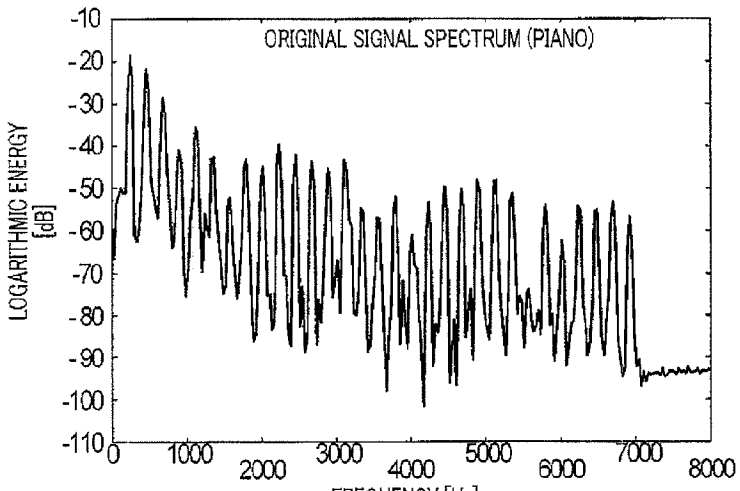
Figure 1D:
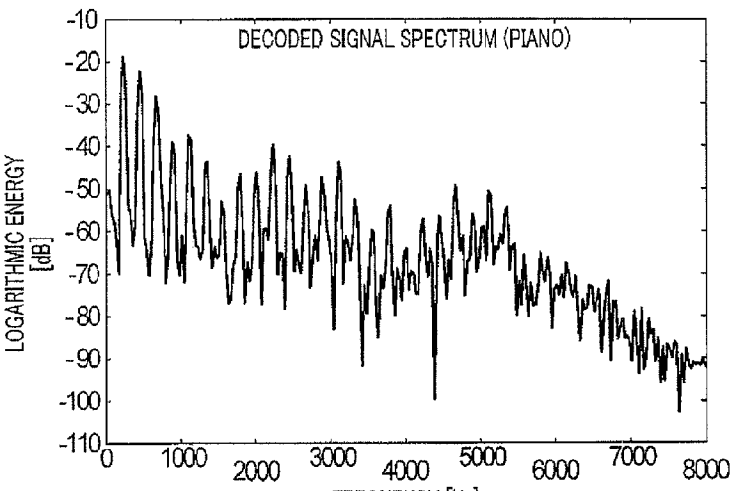
Figure 2:
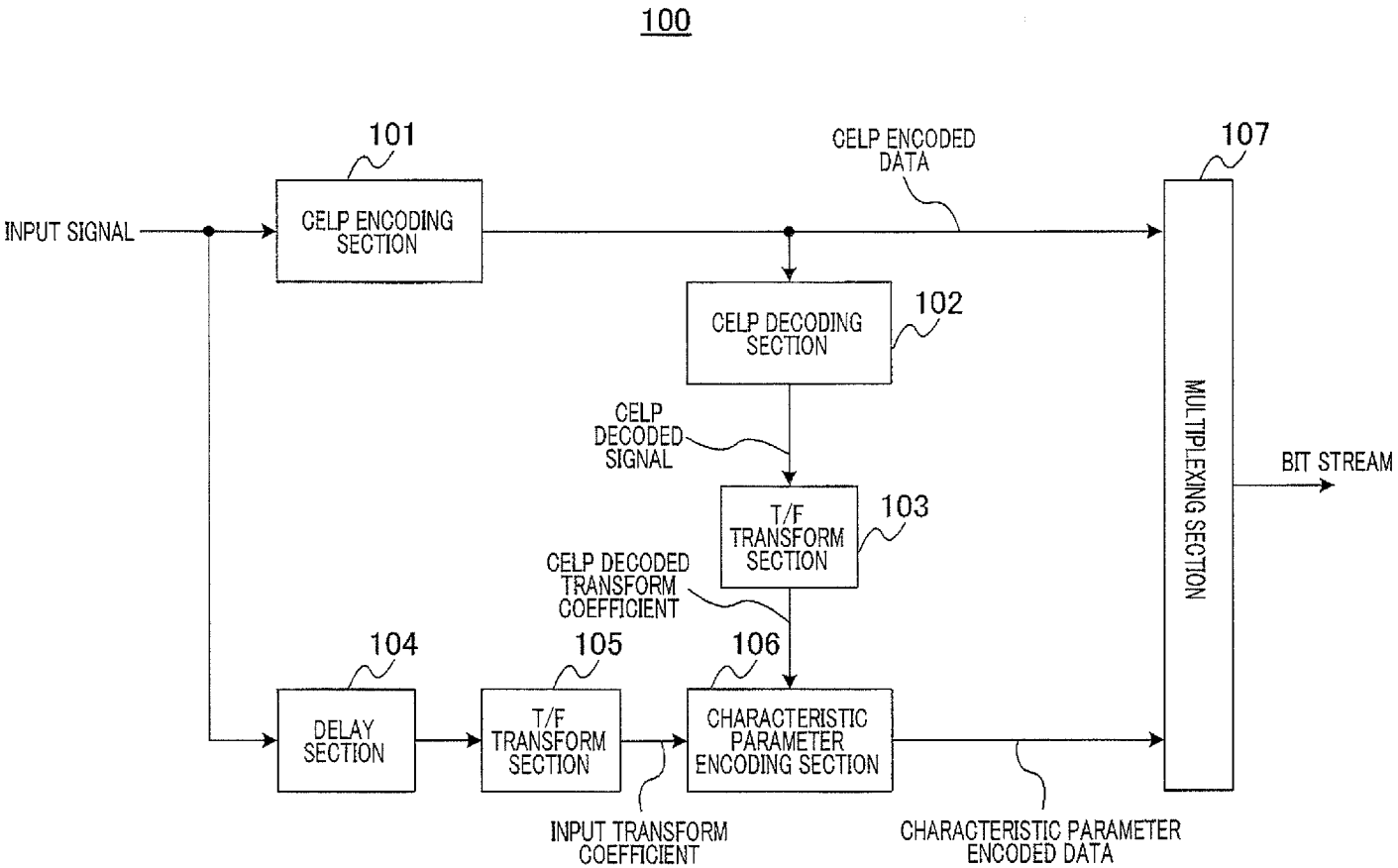
FIG. 2 is a block diagram showing a configuration of an encoding apparatus according to Embodiment 1 of the present invention.

FIG. 2 is a block diagram showing a configuration of main parts of an encoding apparatus according to the present embodiment. Encoding apparatus 100 in FIG. 2 performs encoding processing on an input signal in predetermined time interval (frame) units to generate a bit stream and transmits the bit stream generated to a decoding apparatus which will be described later.

In encoding apparatus 100 shown in FIG. 2, CELP encoding section 101 performs encoding processing on an input signal using CELP encoding to generate CELP encoded data (first encoded data). CELP encoding section 101 outputs the CELP encoded data to CELP decoding section 102 and multiplexing section 107.

CELP decoding section 102 performs CELP decoding processing on the CELP encoded data inputted from CELP encoding section 101 to generate a CELP decoded signal. CELP decoding section 102 outputs the CELP decoded signal to T/F transform section 103.

T/F transform section 103 transforms the CELP decoded signal inputted from CELP decoding section 102 to a frequency domain signal to calculate a CELP decoded transform coefficient and outputs the CELP decoded transform coefficient to characteristic parameter encoding section 106. Here, MDCT (Modified Discrete Cosine Transform) is used for transforming to the frequency domain.

Delay section 104 causes the input signal to delay by a time corresponding to a delay produced in CELP encoding section 101 and CELP decoding section 102 and outputs the delay-adjusted input signal to T/F transform section 105.

T/F transform section 105 transforms the input signal delay-adjusted in delay section 104 to a frequency domain signal to calculate an input transform coefficient and outputs the input transform coefficient to characteristic parameter encoding section 106. MDCT is used for transforming to the frequency domain as in the case of T/F transform section 103.

Characteristic parameter encoding section 106 calculates and encodes a characteristic parameter using the CELP decoded transform coefficient inputted from T/F transform section 103 and the input transform coefficient inputted from T/F transform section 105 and generates characteristic parameter encoded data (second encoded data). Here, the characteristic parameter indicates the amount of fluctuation in the ratio of peak components and floor components between the spectra of the CELP decoded signal and the input signal. Characteristic parameter encoding section 106 outputs the characteristic parameter encoded data to multiplexing section 107. Details of the processing of characteristic parameter encoding section 106 will be described later.

Multiplexing section 107 multiplexes the CELP encoded data (first encoded data) inputted from CELP encoding section 101 and the characteristic parameter encoded data (second encoded data) inputted from characteristic parameter encoding section 106 to generate a bit stream and outputs the bit stream to a transmission channel (not shown).

Figure 3:
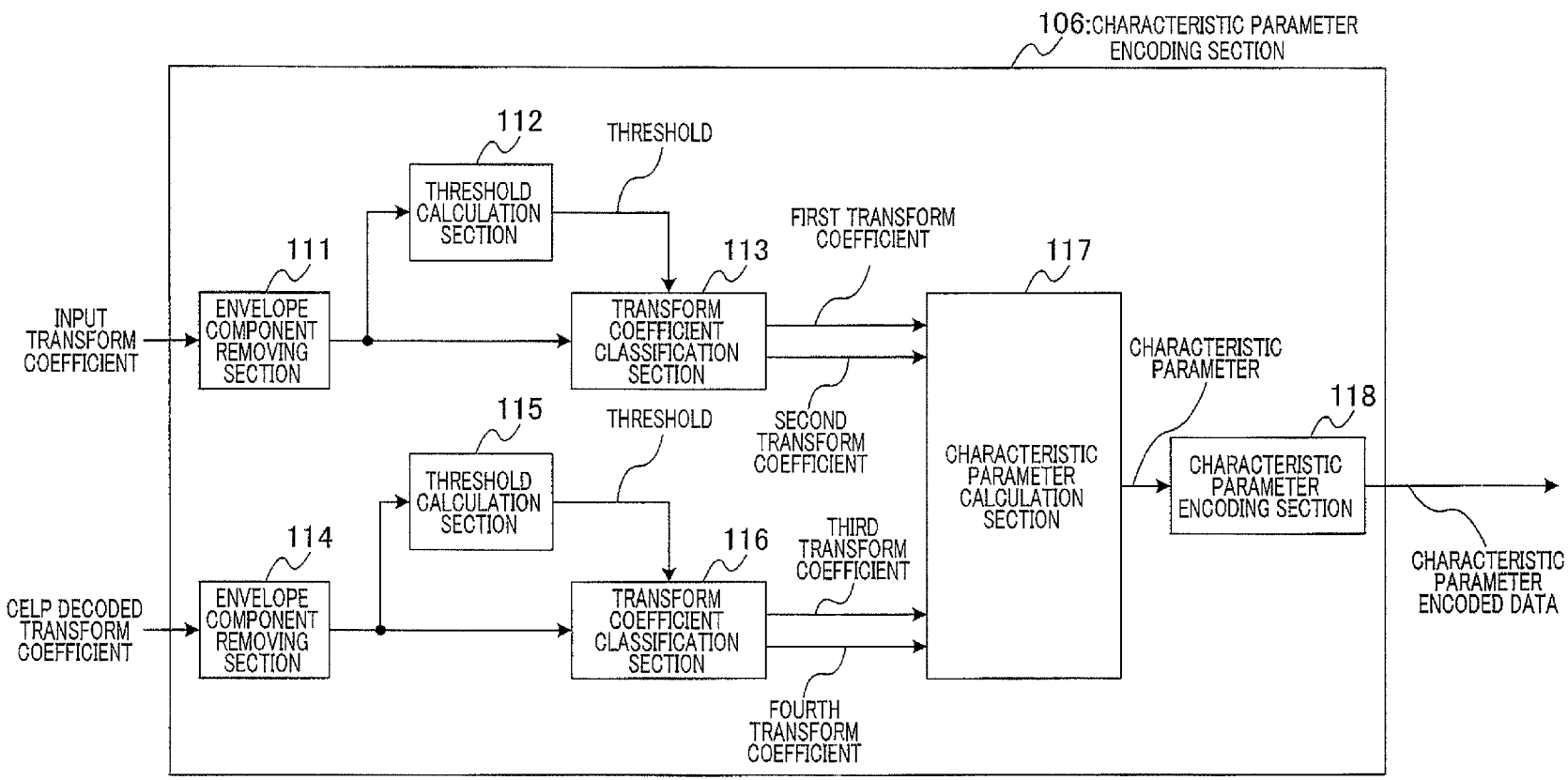
FIG. 3 is a block diagram showing an internal configuration of a characteristic parameter encoding section according to Embodiment 1 of the present invention.

Next, details of the processing of characteristic parameter encoding section 106 in encoding apparatus 100 shown in FIG. 2 will be described. FIG. 3 is a block diagram showing an internal configuration of characteristic parameter encoding section 106.

Envelope component removing section 111 in characteristic parameter encoding section 106 shown in FIG. 3 removes an envelope component (outline component of the spectrum) of the input transform coefficient. For example, envelope component removing section 111 transforms the input transform coefficient from a linear region to a logarithmic region and then performs smoothing processing such as moving average or the like on the transformed input transform coefficient. Envelope component removing section 111 then transforms the input transform coefficient after the smoothing processing from the logarithmic region to the linear region again. Thus, envelope component removing section 111 can obtain an envelope component of the input transform coefficient by performing smoothing processing in the logarithmic region. Envelope component removing section 111 then removes the envelope component obtained from the input transform coefficient and outputs the input transform coefficient after the removal of the envelope component to threshold calculation section 112 and transform coefficient classification section 113.

Threshold calculation section 112 calculates a threshold to classify the input transform coefficient into peak components and floor components using the input transform coefficient after the removal of the envelope component inputted from envelope component removing section 111 and outputs the calculated threshold to transform coefficient classification section 113. To be more specific, threshold calculation section 112 calculates the threshold by performing statistic processing on the input transform coefficient after the removal of the envelope component. Here, a case will be described as an example where as shown in equation 1 below, threshold Th is calculated using standard deviation σ of the absolute value of the input transform coefficient after the removal of the envelope component.

[1]

$$Th = c \cdot \sigma \quad \text{(Equation 1)}$$

Here, c represents a coefficient to determine threshold Th. Furthermore, standard deviation σ of the absolute value of the input transform coefficient is calculated according to following equation 2.

[2]

$$\sigma = \sqrt{\frac{1}{N}\sum_{k}|S_R(k)|^2 - (M_s)^2} \quad \text{(Equation 2)}$$

Here, $S_R(k)$ represents an input transform coefficient after the removal of the envelope component, N represents the number of input transform coefficients and $M_S$ represents a mean value of the absolute value of the input transform coefficient after the removal of the envelope component. Threshold calculation section 112 calculates threshold Th using equations 1 and 2 and outputs calculated threshold Th to transform coefficient classification section 113.

Transform coefficient classification section 113 classifies the input transform coefficient after the removal of the envelope component inputted from envelope component removing section 111 into peak components and floor components using threshold Th inputted from threshold calculation section 112. Transform coefficient classification section 113 outputs an input transform coefficient classified as a peak component and an input transform coefficient classified as a floor component to characteristic parameter calculation section 117 as a first transform coefficient and a second transform coefficient respectively. To be more specific, when the absolute value of input transform coefficient $S_R(k)$ after the removal of the envelope component is equal to or above threshold Th ($|S_R(k)| \geq Th$), transform coefficient classification section 113 classifies input transform coefficient $S_R(k)$ as a peak component. On the other hand, when the absolute value of input transform coefficient $S_R(k)$ after the removal of the envelope component is less than threshold Th (other than $|S_R(k)| \geq Th$, that is, $|S_R(k)| < Th$), transform coefficient classification section 113 classifies input transform coefficient $S_R(k)$ as a floor component.

The magnitude of coefficient c shown in equation 1 has an influences on the classification of peak components and floor components. This coefficient c may be a predetermined fixed value or a variable. When coefficient c is a variable, it may be such a variable that varies according to the pitch gain of CELP encoding, for example (which will be described later).

On the other hand, envelope component removing section 114, threshold calculation section 115 and transform coefficient classification section 116 perform processing similar to processing of envelope component removing section 111, threshold calculation section 112 and transform coefficient classification section 113 on the CELP decoded transform coefficient. That is, envelope component removing section 114 removes the envelope component of the CELP decoded transform coefficient, threshold calculation section 115 calculates a threshold to classify the CELP decoded transform coefficient after the removal of the envelope component into peak components and floor components, transform coefficient classification section 116 classifies the CELP decoded transform coefficient after the removal of the envelope component into peak components and floor components. Transform coefficient classification section 116 outputs a CELP decoded transform coefficient classified as a peak component and a CELP decoded transform coefficient classified as a floor component to characteristic parameter calculation section 117 as a third transform coefficient and a fourth transform coefficient respectively.

Characteristic parameter calculation section 117 calculates a characteristic parameter using the first transform coefficient and the second transform coefficient inputted from transform coefficient classification section 113, and the third transform coefficient and the fourth transform coefficient inputted from transform coefficient classification section 116. To be more specific, characteristic parameter calculation section 117 calculates a ratio of a peak component (first transform coefficient) and a floor component (second transform coefficient) of the input transform coefficient after the removal of the envelope component and a ratio of a peak component (third transform coefficient) and a floor component (fourth transform coefficient) of the CELP decoded transform coefficient after the removal of the envelope component. Characteristic parameter calculation section 117 then calculates the amount of fluctuation in both ratios as a characteristic parameter.

To be more specific, characteristic parameter calculation section 117 calculates a ratio of average energy of the peak components to average energy of the floor components regarding the input transform coefficient after the removal of the envelope component. For example, suppose the first transform coefficient (peak component of the input transform coefficient) is $S_1(k)$ and the second transform coefficient (floor component of the input transform coefficient) is $S_2(k)$. In this case, characteristic parameter calculation section 117 calculates ratio $R_{12}$ of first transform coefficient $S_1(k)$ and second transform coefficient $S_2(k)$ (that is, ratio of the peak components and the floor components in the spectrum of the input signal) according to following equation 3.

[3]

$$R_{12} = \sqrt{\frac{\frac{1}{N_1}\sum_k |S_1(k)|^2}{\frac{1}{N_2}\sum_k |S_2(k)|^2}} \quad \text{(Equation 3)}$$

Here, $N_1$ represents the number of first transform coefficients and $N_2$ represents the number of second transform coefficients.

Similarly, characteristic parameter calculation section 117 calculates a ratio of average energy of the peak components to average energy of the floor components regarding the CELP decoded transform coefficient after the removal of the envelope component. For example, suppose third transform coefficient (peak component of the CELP decoded transform coefficient) is $S_3(k)$ and fourth transform coefficient (floor component of the CELP decoded transform coefficient) is $S_4(k)$. In this case, characteristic parameter calculation section 117 calculates ratio $R_{34}$ of third transform coefficient $S_3(k)$ and fourth transform coefficient $S_4(k)$ (that is, ratio of the peak components and the floor components in the spectrum of the CELP decoded signal) according to following equation 4.

[4]

$$R_{34} = \sqrt{\frac{\frac{1}{N_3}\sum_k |S_3(k)|^2}{\frac{1}{N_4}\sum_k |S_4(k)|^2}} \quad \text{(Equation 4)}$$

Here, $N_3$ represents the number of third transform coefficients and $N_4$ represents the number of fourth transform coefficients.

Characteristic parameter calculation section 117 then calculates characteristic parameter R indicating the amount of fluctuation in ratio $R_{12}$ of average energy of the peak components (first transform coefficient $S_1(k)$) to average energy of the floor components (second transform coefficient $S_2(k)$) of the input transform coefficient after the removal of the envelope component, and ratio $R_{34}$ of average energy of the peak components (third transform coefficient $S_3(k)$) to average energy of the floor components (fourth transform coefficient $S_4(k)$) of the CELP decoded transform coefficient after the removal of the envelope component according to next equation 5.

[5]

$$R = \frac{R_{12}}{R_{34}} \quad \text{(Equation 5)}$$

That is, characteristic parameter calculation section 117 calculates characteristic parameter R indicating the amount of fluctuation in the ratio of the peak components and the floor components between the spectra of the CELP decoded signal and the input signal. Characteristic parameter calculation section 117 then outputs calculated characteristic parameter R to characteristic parameter encoding section 118.

Characteristic parameter encoding section 118 encodes the characteristic parameter inputted from characteristic parameter calculation section 117 and generates characteristic parameter encoded data. Characteristic parameter encoding section 118 outputs the characteristic parameter encoded data to multiplexing section 107 shown in FIG. 2. For example, characteristic parameter encoding section 118 makes matching between a quantization table provided beforehand and the characteristic parameter. Characteristic parameter encoding section 118 outputs an index indicating a parameter candidate having the smallest error from the characteristic parameter among a plurality of parameter candidates included in the quantization table as the characteristic parameter encoded data. Alternatively, characteristic parameter encoding section 118 may also directly generate the characteristic parameter encoded data from the characteristic parameter through predetermined arithmetic processing.

Figure 4:
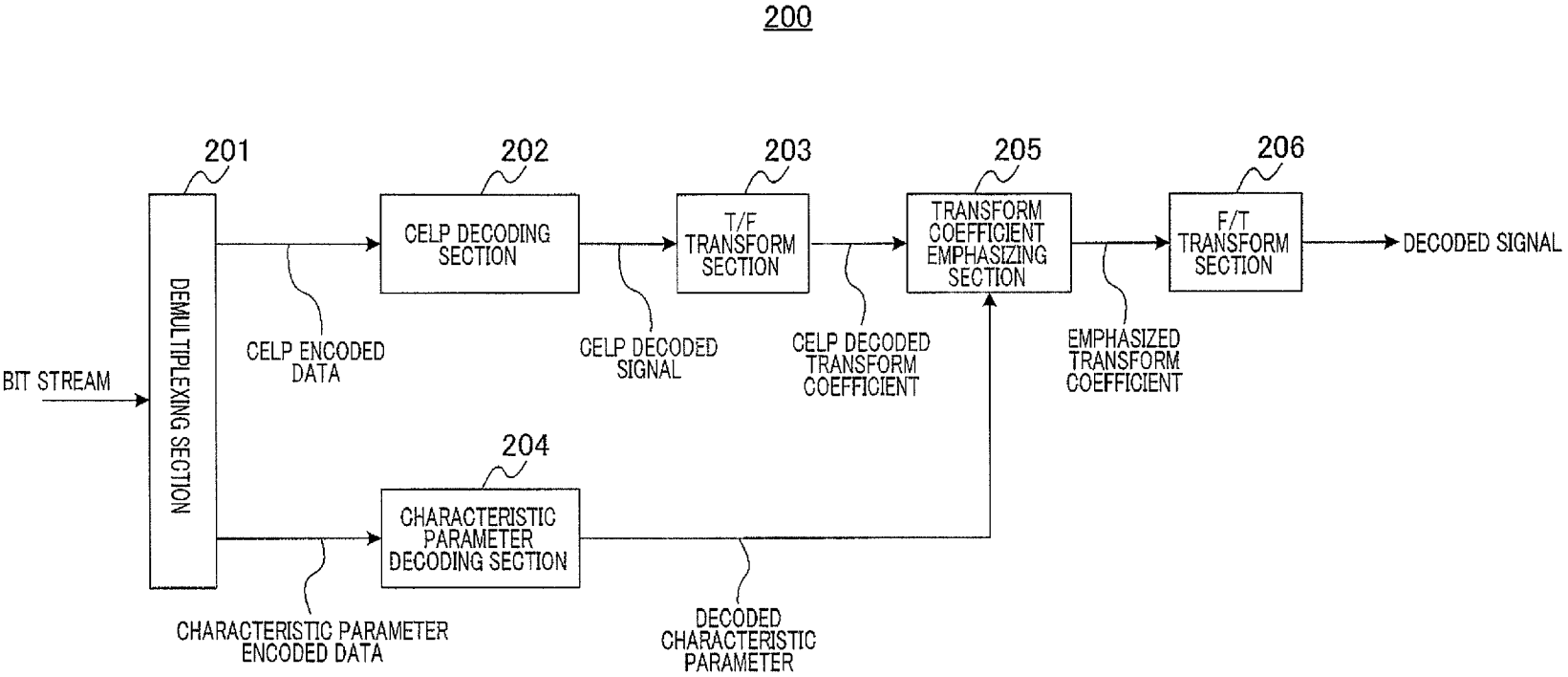
FIG. 4 is a block diagram showing a configuration of a decoding apparatus according to Embodiment 1 of the present invention.

FIG. 4 is a block diagram showing a configuration of main parts of a decoding apparatus according to the present embodiment. Decoding apparatus 200 in FIG. 4 receives and decodes a bit stream outputted from encoding apparatus 100 (FIG. 2).

In decoding apparatus 200 shown in FIG. 4, demultiplexing section 201 demultiplexes the bit stream inputted via a transmission channel (not shown) into CELP encoded data and characteristic parameter encoded data. Demultiplexing section 201 outputs the CELP encoded data to CELP decoding section 202 and outputs the characteristic parameter encoded data to characteristic parameter decoding section 204.

CELP decoding section 202 performs decoding processing on the CELP encoded data inputted from demultiplexing section 201 (encoded data obtained by encoding the input signal in encoding apparatus 100), generates a CELP decoded signal and outputs the generated CELP decoded signal to T/F transform section 203.

T/F transform section 203 transforms the CELP decoded signal inputted from CELP decoding section 202 to a frequency domain signal, calculates a CELP decoded transform coefficient and outputs the CELP decoded transform coefficient to transform coefficient emphasizing section 205. Here, MDCT is used for transforming to the frequency domain.

Characteristic parameter decoding section 204 performs decoding processing on the characteristic parameter encoded data inputted from demultiplexing section 201, generates a decoded characteristic parameter and outputs the generated decoded characteristic parameter to transform coefficient emphasizing section 205.

Transform coefficient emphasizing section 205 emphasizes peak performance of the CELP decoded transform coefficient inputted from T/F transform section 203 using the decoded characteristic parameter inputted from characteristic parameter decoding section 204. To be more specific, transform coefficient emphasizing section 205 adjusts the amplitude of peak components of the spectrum (CELP decoded transform coefficient) of the CELP decoded signal using a decoded characteristic parameter indicating the amount of fluctuation in the ratio of the peak components and the floor components between the spectra of the CELP decoded signal and the input signal. Transform coefficient emphasizing section 205 outputs the CELP decoded transform coefficient whose peak performance has been emphasized (hereinafter referred to as "emphasized transform coefficient") to F/T transform section 206. Details of the processing in transform coefficient emphasizing section 205 will be described later.

F/T transform section 206 transforms the emphasized transform coefficient inputted from transform coefficient emphasizing section 205 to a time domain signal, calculates a decoded signal and outputs the calculated decoded signal.

Figure 5:
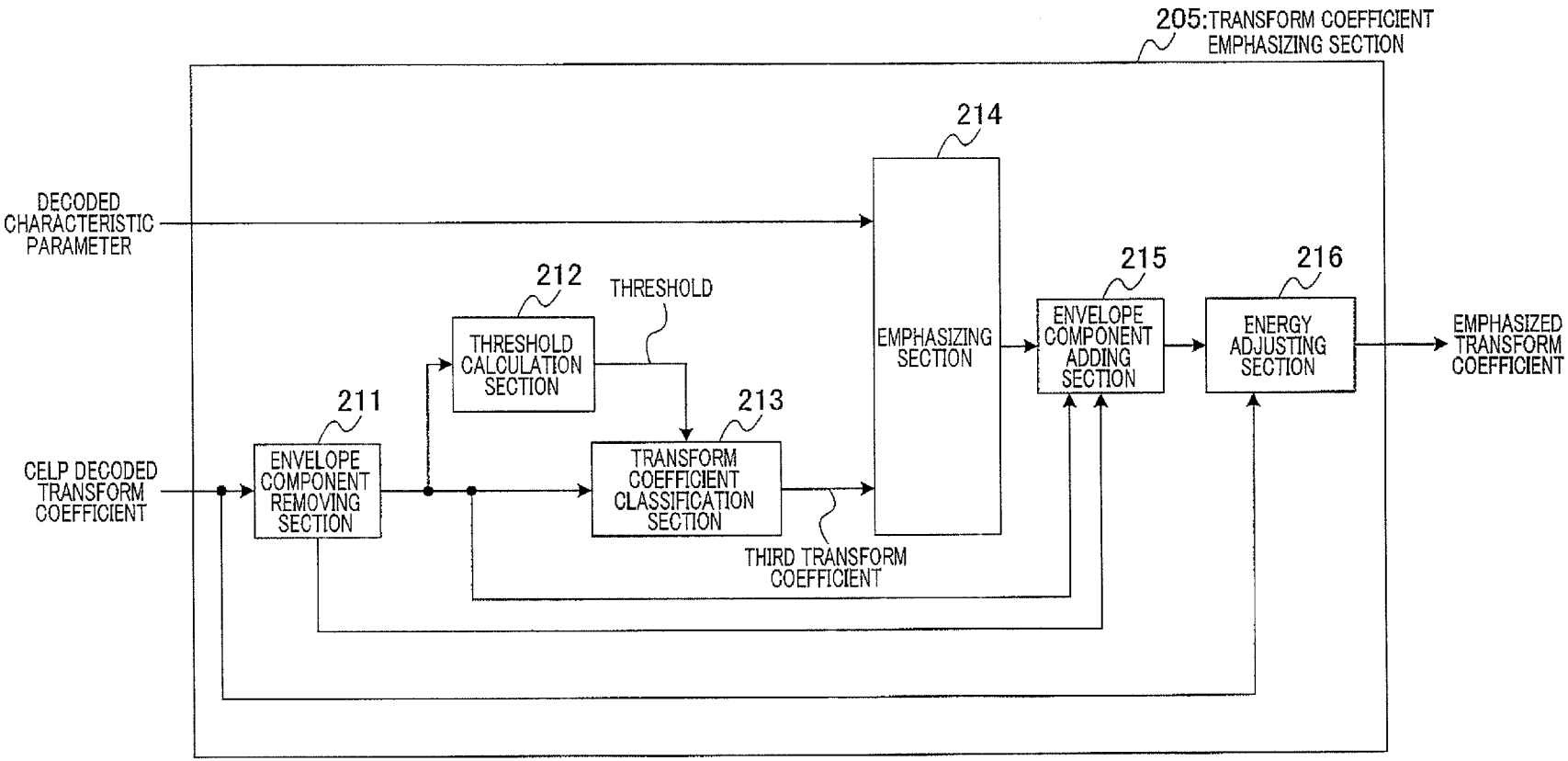
FIG. 5 is a block diagram showing an internal configuration of a transform coefficient emphasizing section according to Embodiment 1 of the present invention.

Next, details of the processing of transforms coefficient emphasizing section 205 of decoding apparatus 200 shown in FIG. 4 will be described. FIG. 5 is a block diagram showing an internal configuration of transform coefficient emphasizing section 205.

In transform coefficient emphasizing section 205 shown in FIG. 5, envelope component removing section 211 removes the envelope component of the CELP decoded transform coefficient inputted from T/F transform section 203 (FIG. 4) in the same way as in envelope component removing section 114 (FIG. 3). Envelope component removing section 211 then outputs the CELP decoded transform coefficient after the removal of the envelope component to threshold calculation section 212 and transform coefficient classification section 213. Furthermore, envelope component removing section 211 outputs the envelope component of the CELP decoded transform coefficient and the CELP decoded transform coefficient after the removal of the envelope component to envelope component adding section 215. Envelope component removing section 211 is different from envelope component removing section 114 (FIG. 3) in that it outputs the envelope component of the CELP decoded transform coefficient and the CELP decoded transform coefficient after the removal of the envelope component to envelope component adding section 215.

Threshold calculation section 212 calculates a threshold to classify the CELP decoded transform coefficient into peak components and floor components using the CELP decoded transform coefficient after the removal of the envelope component inputted from envelope component removing section 211 in the same way as in threshold calculation section 115 (FIG. 3). Threshold calculation section 212 outputs the calculated threshold to transform coefficient classification section 213.

Transform coefficient classification section 213 classifies the peak components from the CELP decoded transform coefficient after the removal of the envelope component inputted from envelope component removing section 211 using the threshold inputted from threshold calculation section 212 in the same way as in transform coefficient classification section 116 (FIG. 3) and outputs the CELP decoded transform coefficient classified as the peak components to emphasizing section 214 as a third transform coefficient. Thus, transform coefficient classification section 213 is different from transform coefficient classification section 116 (FIG. 3) in that it classifies and outputs only the peak components.

Emphasizing section 214 emphasizes the third transform coefficient (peak components of the CELP decoded transform coefficient after the removal of the envelope component) inputted from transform coefficient classification section 213 using the decoded characteristic parameter inputted from characteristic parameter decoding section 204 (FIG. 4). For example, emphasizing section 214 multiplies third transform coefficient $S_3(k)$ by decoded characteristic parameter $R_q$ as shown in following equation 6.

[6]

$$S'_3(k)=S_3(k)\cdot R_q \quad \text{(Equation 6)}$$

In this way, emphasizing section 214 adjusts the amplitude of the peak components of the spectrum of the CELP decoded signal using the characteristic parameter. Emphasizing section 214 then outputs emphasized third transform coefficient $S_3'(k)$ to envelope component adding section 215.

Envelope component adding section 215 multiplies the emphasized third transform coefficient inputted from emphasizing section 214 by the envelope component of the CELP decoded transform coefficient inputted from envelope component removing section 211, and thereby adds the envelope component to the emphasized third transform coefficient. Envelope component adding section 215 outputs the third transform coefficient with the envelope component added thereto to energy adjusting section 216.

For example, suppose the CELP decoded transform coefficient from which the envelope component has been removed is $S_R(k)$. In this case, envelope component adding section 215 substitutes the emphasized third transform coefficient $S_3'(k)$ (that is, peak components whose amplitude has been adjusted) for the components at the positions corresponding to the peak components of the CELP decoded transform coefficient among components of CELP decoded transform coefficient $S_R(k)$ after the removal of the envelope component according to following equation 7 first and generates transform coefficient $S_R'(k)$.

[7]

$$S'_R(k)=\begin{cases} S'_3(k') & \text{if } k=k' \\ S_R(k') & \text{if } k\neq k' \end{cases} \quad \text{(Equation 7)}$$

Where, k' represents the position corresponding to a peak component.

Next, envelope component adding section 215 multiplies transform coefficient $S_R'(k)$ shown in equation 7 by the envelope component obtained in envelope component removing section 211, and thereby adds the envelope component to transform coefficient $S_R'(k)$ to generate transform coefficient $S_C'(k)$. Envelope component adding section 215 outputs generated transform coefficient $S_C'(k)$ to energy adjusting section 216.

Energy adjusting section 216 adjusts the energy of transform coefficient $S_C'(k)$ so that the energy of transform coefficient $S_C'(k)$ inputted from envelope component adding section 215 matches the energy of the original CELP decoded transform coefficient. Energy adjusting section 216 then outputs transform coefficient $S_C'(k)$ after the energy adjustment to FIT transform section 206 (FIG. 4) as the emphasized transform coefficient.

For example, energy adjusting section 216 calculates energy adjusting coefficient g according to following equation 8 so that the energy of transform coefficient $S_C'(k)$ matches the energy of original CELP decoded transform coefficient $S_C(k)$.

[8]

$$g = \sqrt{\frac{\sum_k S_C(k)^2}{\sum_k S'_C(k)^2}} \quad \text{(Equation 8)}$$

Energy adjusting section 216 multiplies transform coefficient $S_C'(k)$ by energy adjusting coefficient g as shown in following equation 9 to generate emphasized transform coefficient $S_E(k)$.

[9]

$$S_E(k)=g\cdot S'_C(k) \quad \text{(Equation 9).}$$

Next, a processing flow of transform coefficient emphasizing section 205 (FIG. 5) will be described in detail using FIG. 6A to FIG. 6D. FIG. 6A to FIG. 6D show a situation until an emphasized transform coefficient is generated from the CELP decoded transform coefficient inputted to transform coefficient emphasizing section 205.

To be more specific, as shown in FIG. 6A, transform coefficient classification section 213 of transform coefficient emphasizing section 205 classifies the peak components of the CELP decoded transform coefficient whose envelope component has been removed in envelope component removing section 211 to generate a third transform coefficient.

Next, as shown in FIG. 6A, emphasizing section 214 emphasizes the peak components by adjusting the amplitude of the third transform coefficient, that is, the peak components of the CELP decoded transform coefficient after the removal of the envelope component. Envelope component adding section 215 then substitutes the emphasized third transform coefficient for the peak components of the CELP decoded transform coefficient after the removal of the envelope component according to equation 7. Thus, CELP decoded transform coefficient ($S_R'(k)$ shown in equation 7) after the emphasis of the peak components is generated as shown in FIG. 6B.

Next, envelope component adding section 215 adds the envelope component to the CELP decoded transform coefficient after the emphasis of the peak components (CELP decoded transform coefficient whose envelope component has been removed) shown in FIG. 6B to generate transform coefficient $S_C'(k)$ shown in FIG. 6C.

Energy adjusting section 216 adjusts the energy of transform coefficient $S_C'(k)$ so that the energy of transform coefficient $S_C'(k)$ shown in FIG. 6C matches the energy of the CELP decoded transform coefficient to generate emphasized transform coefficient $S_E(k)$ shown in FIG. 6D.

Thus, encoding apparatus 100 calculates the amount of fluctuation in the ratio of the peak components (third transform coefficient) and floor components (fourth transform coefficient) of the spectrum (CELP decoded transform coefficient) of the CELP decoded signal and the ratio of the peak components (first transform coefficient) and floor components (second transform coefficient) of the spectrum (input transform coefficient) of the input signal as a characteristic parameter. Encoding apparatus 100 transmits characteristic parameter encoded data obtained by encoding the characteristic parameter to decoding apparatus 200. On the other hand, decoding apparatus 200 decodes the characteristic parameter encoded data transmitted from encoding apparatus 100 to obtain the characteristic parameter (decoded characteristic parameter) and emphasizes (adjusts the amplitude of) the peak components (third transform coefficient) of the CELP decoded signal (CELP decoded transform coefficient) using the characteristic parameter.

That is, decoding apparatus 200 controls the ratio of the peak components and floor components of the CELP decoded signal using the characteristic parameter to thereby cause the ratio of the peak components and floor components of the CELP decoded signal to approximate to the ratio of the peak components and floor components of the input signal. This prevents a peak shape of the decoded signal spectrum from collapsing and reduces noiseness of the CELP decoded signal due to the suppression (increase of floor components) of the sizes of crests and troughs of peaks of the spectrum, and can thereby improve the quality of the decoded signal.

In other words, encoding apparatus 100 frequency-analyzes the input signal, expresses the intensity of peak performance of the spectrum (input transform coefficient) of the input signal as a characteristic parameter, encodes the characteristic parameter and transmits the encoded characteristic parameter to decoding apparatus 200. In this way, decoding apparatus 200 can generate a decoded signal having the intensity of peak performance similar to the intensity of peak performance of the spectrum (input transform coefficient) of the input signal using the characteristic parameter transmitted from encoding apparatus 100, and can thereby improve the quality of the decoded signal. That is, a sound quality improvement effect can also be achieved for a music signal in which performing CELP encoding causes the peak shapes of the decoded signal spectrum to collapse, increasing the floor components and making the sound quality more likely to degrade a great deal.

Thus, even when encoding a music signal using CELP encoding, the present embodiment can improve the quality of the decoded signal.

Furthermore, encoding apparatus 100 obtains the intensity of peak performance as a characteristic parameter for each frequency component of an input signal and decoding apparatus 200 controls the intensity of peak performance of the CELP decoded signal for each frequency component to generate a decoded signal, and it is thereby possible to realize accurate control to improve sound quality. Thus, according to the present embodiment, decoding apparatus 200 can control the intensity of peak performance of the spectrum of the CELP decoded signal for each frequency component, and can thereby improve sound quality of a music signal.

In the present embodiment, the encoding apparatus (characteristic parameter encoding section) may perform non-linear transform such as logarithmic transform on the characteristic parameter and perform encoding processing on the characteristic parameter after the non-linear transform.

Furthermore, a case has been described in the present embodiment where a threshold is calculated to classify the transform coefficient into peak components and floor components using a standard deviation of the absolute value of the transform coefficient (input transform coefficient or CELP decoded transform coefficient) after the removal of the envelope component. However, when calculating a threshold, a mean value of the absolute value of the transform coefficient (input transform coefficient or CELP decoded transform coefficient) after the removal of the envelope component may also be used.

The present embodiment has described a configuration using CELP encoding for the encoding apparatus. However, other time domain encoding schemes other than CELP encoding or encoding schemes having a low bit rate also have a problem that quality with respect to a music signal is low. The present invention is also applicable to such encoding schemes other than CELP encoding and applying the present invention allows the music quality to be improved.

Furthermore, a feature of the present invention is to attenuate floor components which are increased through encoding processing, generate a decoded signal having the intensity of peak performance similar to the intensity of peak performance of the spectrum of the input signal and improve the quality. Therefore, the present embodiment has described the present invention on the premise of validity with respect to a music signal. However, the present invention can exert the quality improvement effect due to attenuation of floor components with respect to not only a music signal but also a speech signal. In a speech signal on which a signal such as background noise is superimposed in particular, floor components tend to increase by performing encoding processing and the present invention is further effective for such a case.

Embodiment 2

The present embodiment will describe a case where a characteristic parameter is calculated further using a pitch gain in CELP encoding in addition to Embodiment 1.

Figure 7:
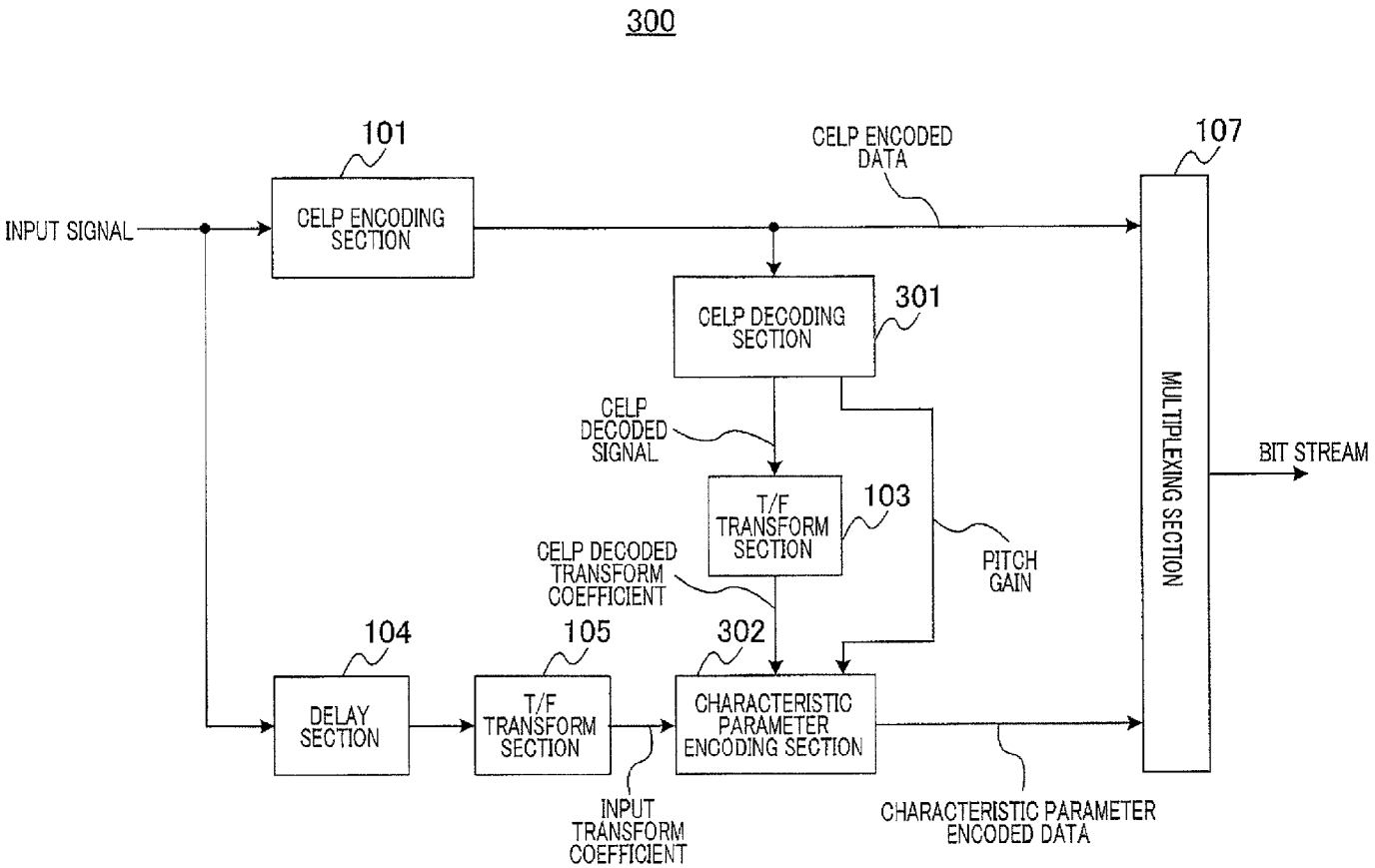
FIG. 7 is a block diagram showing a configuration of an encoding apparatus according to Embodiment 2 of the present invention.

Hereinafter, the present embodiment will be described more specifically. FIG. 7 is a block diagram showing a configuration of main parts of an encoding apparatus according to the present embodiment. In encoding apparatus 300 in FIG. 7, components common to those of encoding apparatus 100 shown in FIG. 2 will be assigned the same reference numerals as those in FIG. 2 and descriptions thereof will be omitted.

In encoding apparatus 300 shown in FIG. 7, CELP decoding section 301 performs decoding processing on CELP encoded data inputted from CELP encoding section 101, generates a CELP decoded signal, outputs the generated CELP decoded signal to T/F transform section 103, decodes a pitch gain generated upon decoding processing and outputs the decoded pitch gain to characteristic parameter encoding section 302. Here, the pitch gain is a gain value by which an adaptive vector used for CELP encoding (vector generated in an adaptive codebook that stores past excitation signals) is multiplied. Furthermore, the pitch gain corresponds to the strength of periodicity of an input signal. The pitch gain increases when, for example, the input signal has strong periodicity such as a vowel, whereas the pitch gain decreases when the input signal has weak periodicity such as a consonant.

Characteristic parameter encoding section 302 calculates a characteristic parameter and performs encoding to generate characteristic parameter encoded data using the CELP decoded transform coefficient inputted from T/F transform section 103, the input transform coefficient inputted from T/F transform section 105 and the pitch gain inputted from CELP decoding section 301.

Figure 8:
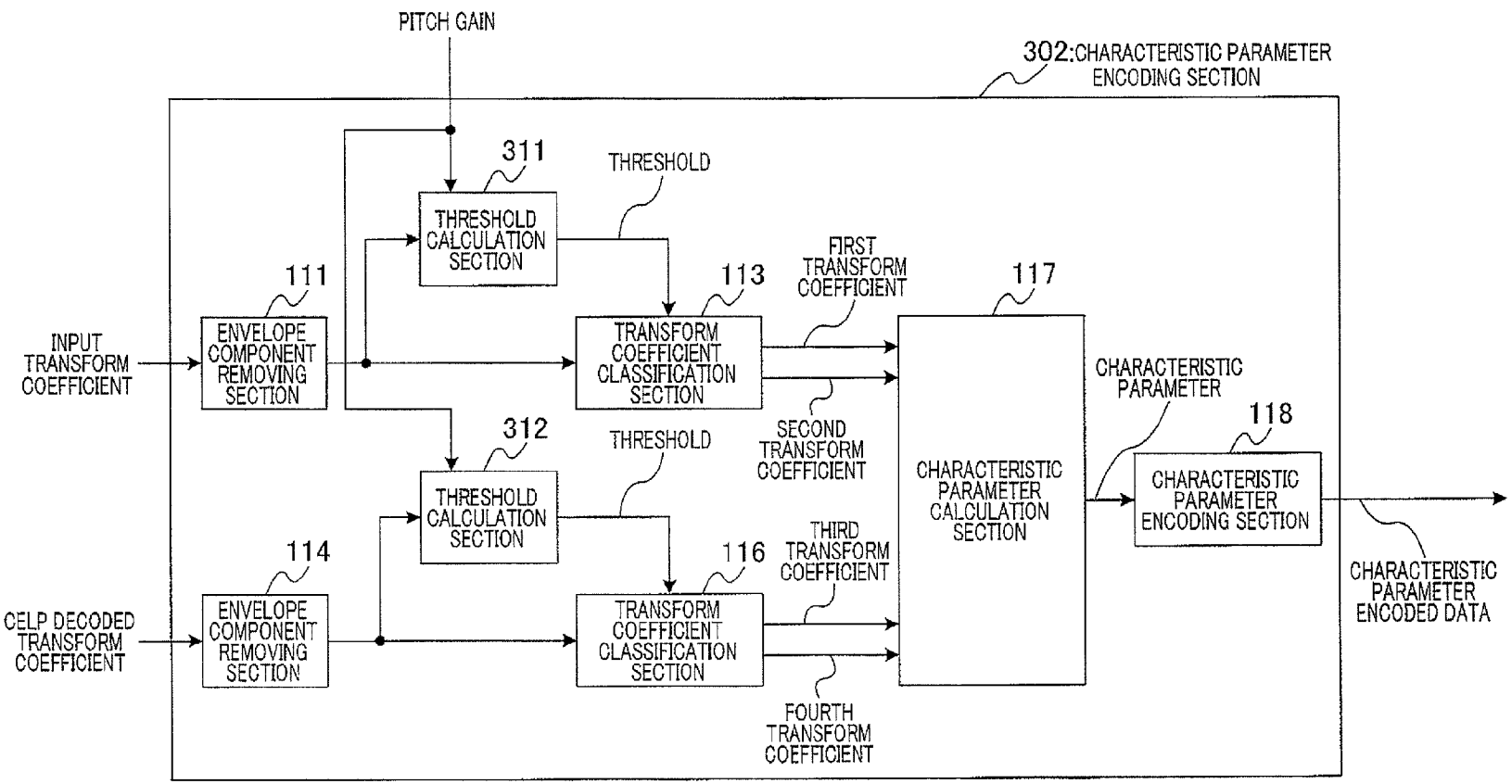
FIG. 8 is a block diagram showing an internal configuration of a characteristic parameter encoding section according to Embodiment 2 of the present invention.

Next, details of the processing in characteristic parameter encoding section 302 of encoding apparatus 300 shown in FIG. 7 will be described. FIG. 8 is a block diagram showing an internal configuration of characteristic parameter encoding section 302. In characteristic parameter encoding section 302 in FIG. 8, components common to those of characteristic parameter encoding section 106 shown in FIG. 3 will be assigned the same reference numerals as those in FIG. 3 and descriptions thereof will be omitted.

In characteristic parameter encoding section 302 shown in FIG. 8, threshold calculation section 311 calculates a threshold to classify the input transform coefficient into peak components and floor components using the input transform coefficient after the removal of the envelope component inputted from envelope component removing section 111 and the pitch gain inputted from CELP decoding section 301 (FIG. 7).

Here, Embodiment 1 has described the case where threshold calculation section 112 (FIG. 3) multiplies the statistic value of the input transform coefficient after the removal of the envelope component (standard deviation of the absolute value of the input transform coefficient) by coefficient c (equation 1). By contrast, threshold calculation section 311 according to the present embodiment adjusts, using the pitch gain, the value of a coefficient by which the statistic value of the above-described input transform coefficient is multiplied.

To be more specific, threshold calculation section 311 stores a table of coefficients corresponding to the pitch gain and uses a candidate corresponding to the inputted pitch gain of the candidate group of coefficients stored in the table. For example, when the pitch gain is assumed to be g, threshold calculation section 311 calculates threshold Th according to following equation 10.

[10]

$$Th = c[\mathrm{INT}(N \cdot g / g_\max)] \cdot \sigma \qquad \text{(Equation 10)}$$

Here, c[ ] represents a table that stores a candidate group of coefficients and table c[ ] stores coefficients in order from a minimum value to a maximum value in such a way that a greater coefficient is selected for a greater value of pitch gain g. Furthermore, N represents the number of coefficients (candidates) stored in the table and g_max represents a maximum value that the pitch gain can take. Furthermore, function INT(x) represents a function that outputs an integer value of argument x.

Thus, threshold calculation section 311 increases the value of a coefficient used for a threshold calculation as pitch gain g increases (as the periodicity becomes stronger), and thereby sets high threshold Th to classify the transform coefficient as peak components. This allows only transform coefficients of strong peak performance to be selected as peak components and makes it possible to calculate a more accurate characteristic parameter.

Threshold calculation section 312 calculates a threshold to classify the CELP decoded transform coefficient into peak components and floor components using the CELP decoded transform coefficient after the removal of the envelope component inputted from envelope component removing section 114 and the pitch gain inputted from CELP decoding section 301 (FIG. 7) as in the case of threshold calculation section 311.

Figure 9:
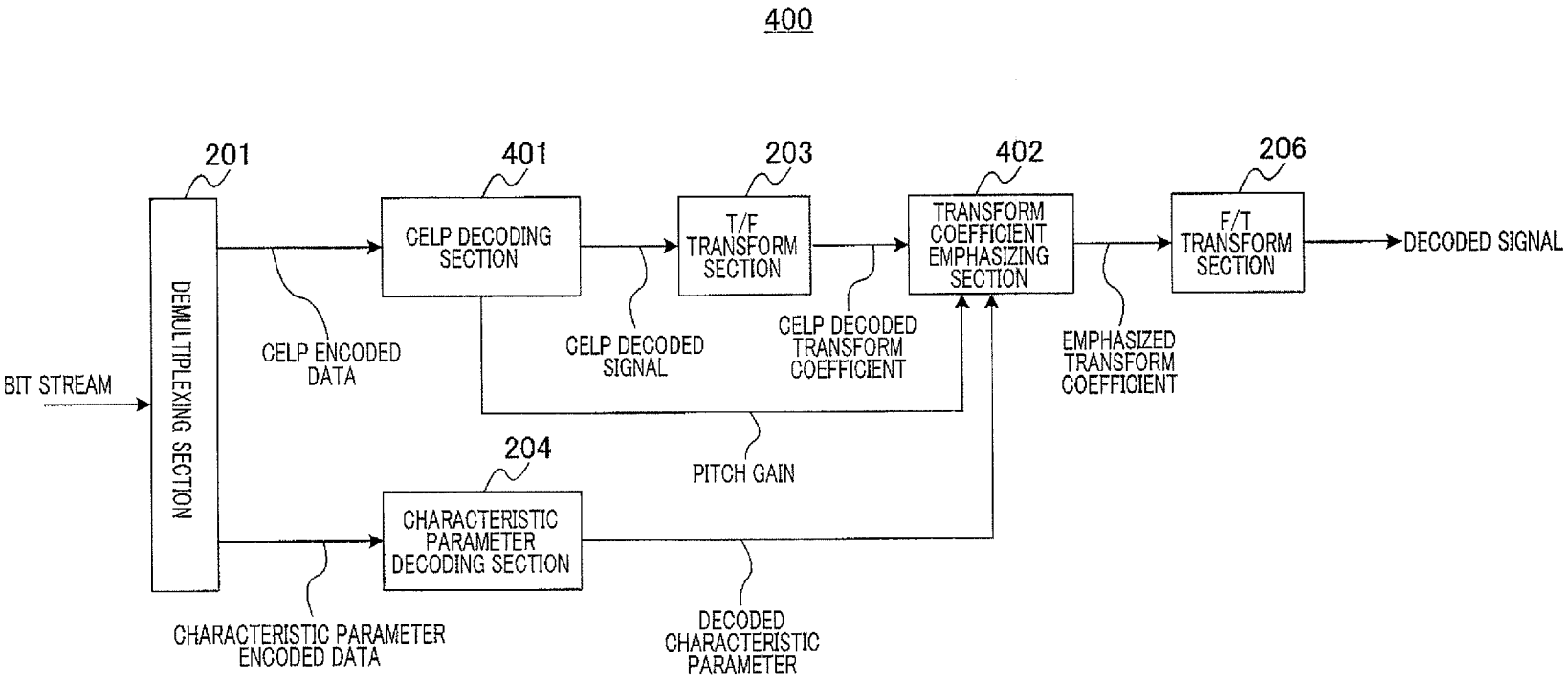
FIG. 9 is a block diagram showing a configuration of a decoding apparatus according to Embodiment 2 of the present invention.

FIG. 9 is a block diagram showing a configuration of main parts of the decoding apparatus according to the present embodiment. In decoding apparatus 400 in FIG. 9, components common to those of decoding apparatus 200 shown in FIG. 4 will be assigned the same reference numerals as those in FIG. 4 and descriptions thereof will be omitted.

In decoding apparatus 400 shown in FIG. 9, CELP decoding section 401 decodes CELP encoded data, generates a CELP decoded signal, decodes a pitch gain generated during decoding processing and outputs the decoded pitch gain to transform coefficient emphasizing section 402 as in the case of CELP decoding section 301 (FIG. 7).

Transform coefficient emphasizing section 402 emphasizes peak performance of the CELP decoded transform coefficient inputted from T/F transform section 203 using the decoded characteristic parameter inputted from characteristic parameter decoding section 204 and the pitch gain inputted from CELP decoding section 401.

Figure 10:
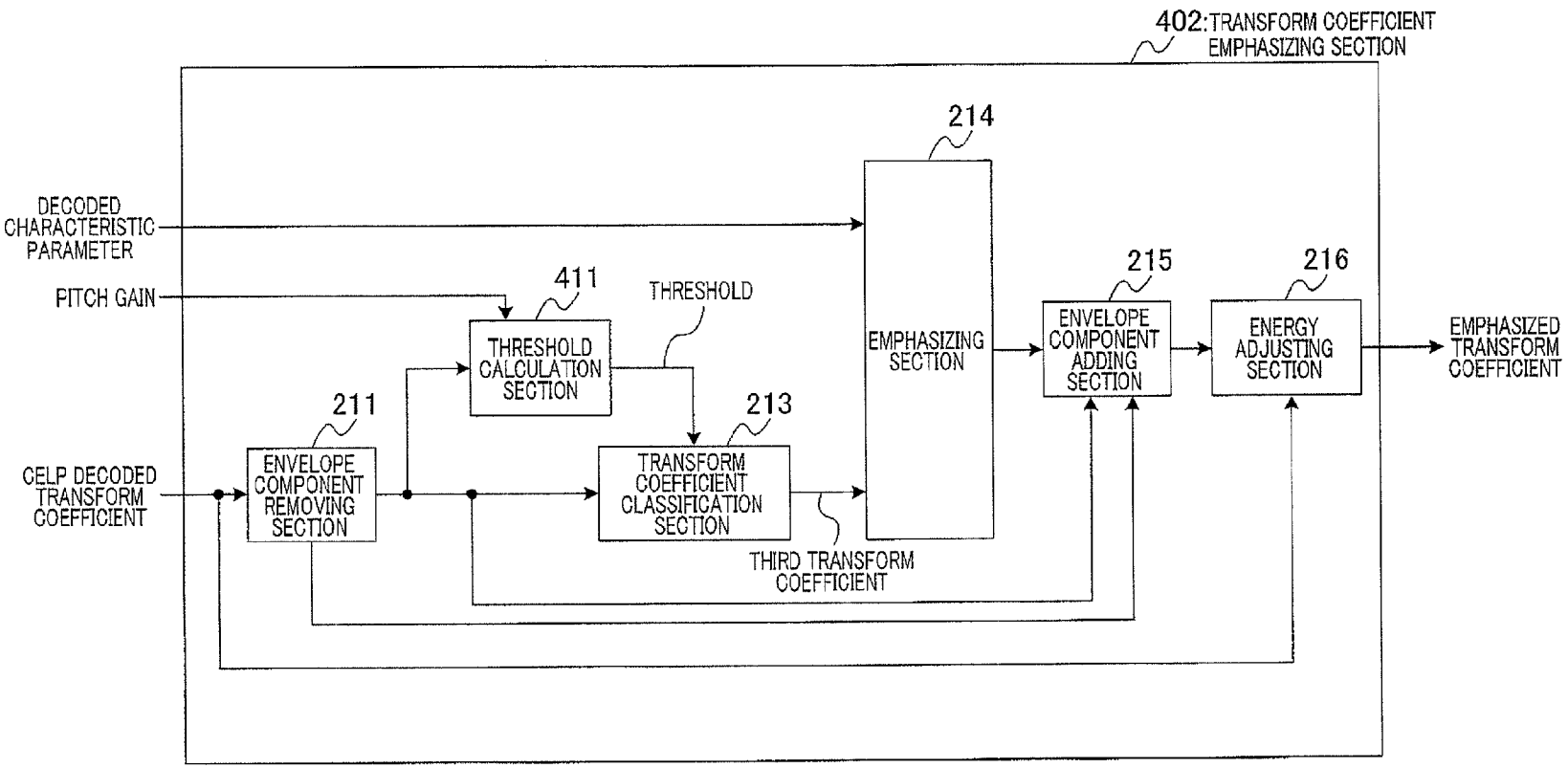
FIG. 10 is a block diagram showing an internal configuration of a transform coefficient emphasizing section according to Embodiment 2 of the present invention.

Next, details of the processing of transform coefficient emphasizing section 402 in decoding apparatus 400 shown in FIG. 9 will be described. FIG. 10 is a block diagram showing an internal configuration of transform coefficient emphasizing section 402. In transform coefficient emphasizing section 402 in FIG. 10, components common to those of transform coefficient emphasizing section 205 shown in FIG. 5 will be assigned the same reference numerals as those in FIG. 5 and descriptions thereof will be omitted.

In transform coefficient emphasizing section 402 shown in FIG. 10, threshold calculation section 411 calculates a threshold (threshold Th shown in equation 10) to classify peak components from the CELP decoded transform coefficient using the CELP decoded transform coefficient after the removal of the envelope component and the pitch gain inputted from CELP decoding section 401 (FIG. 9) as in the case of threshold calculation section 312 (FIG. 8).

In this way, encoding apparatus 300 and decoding apparatus 400 estimate encoding performance with respect to peak components by CELP encoding using a pitch gain corresponding to strength of periodicity of an input signal and control calculation processing of the characteristic parameter (to be more specific, a threshold) based on the estimation result. In this case, it is also possible to reduce noiseness in the CELP decoded signal and improve the quality of the decoded signal as in the case of Embodiment 1.

Furthermore, hi the present embodiment, encoding apparatus 300 calculates a characteristic parameter using the pitch gain in CELP encoding. This allows decoding apparatus 400 to adjust the intensity of peak performance of the spectrum of the CELP decoded signal according to the coding performance of CELP encoding with respect to peak components of the spectrum, and can thereby obtain a further sound quality improvement effect of the CELP decoded signal.

Thus, when encoding a music signal using CELP encoding, the present embodiment can further improve the quality of the decoded signal compared to Embodiment 1.

A case has been described in the present embodiment where a pitch gain is used to measure the strength of periodicity of an input signal, but a correlation value obtained by correlation-analyzing an input signal may also be used instead of the pitch gain when measuring the strength of periodicity of the input signal. Alternatively, the pitch gain and the above-described correlation value may be combined to calculate the strength of periodicity of the input signal.

Embodiment 3

A case has been described in Embodiment 1 and Embodiment 2 where the encoding apparatus uses one threshold when classifying a transform coefficient (input transform coefficient or CELP decoded transform coefficient) into peak components and floor components. By contrast, the present embodiment will describe a case where the encoding apparatus uses two thresholds; a threshold to classify a transform coefficient as peak components and a threshold to classify a transform coefficient as floor components.

Figure 11:
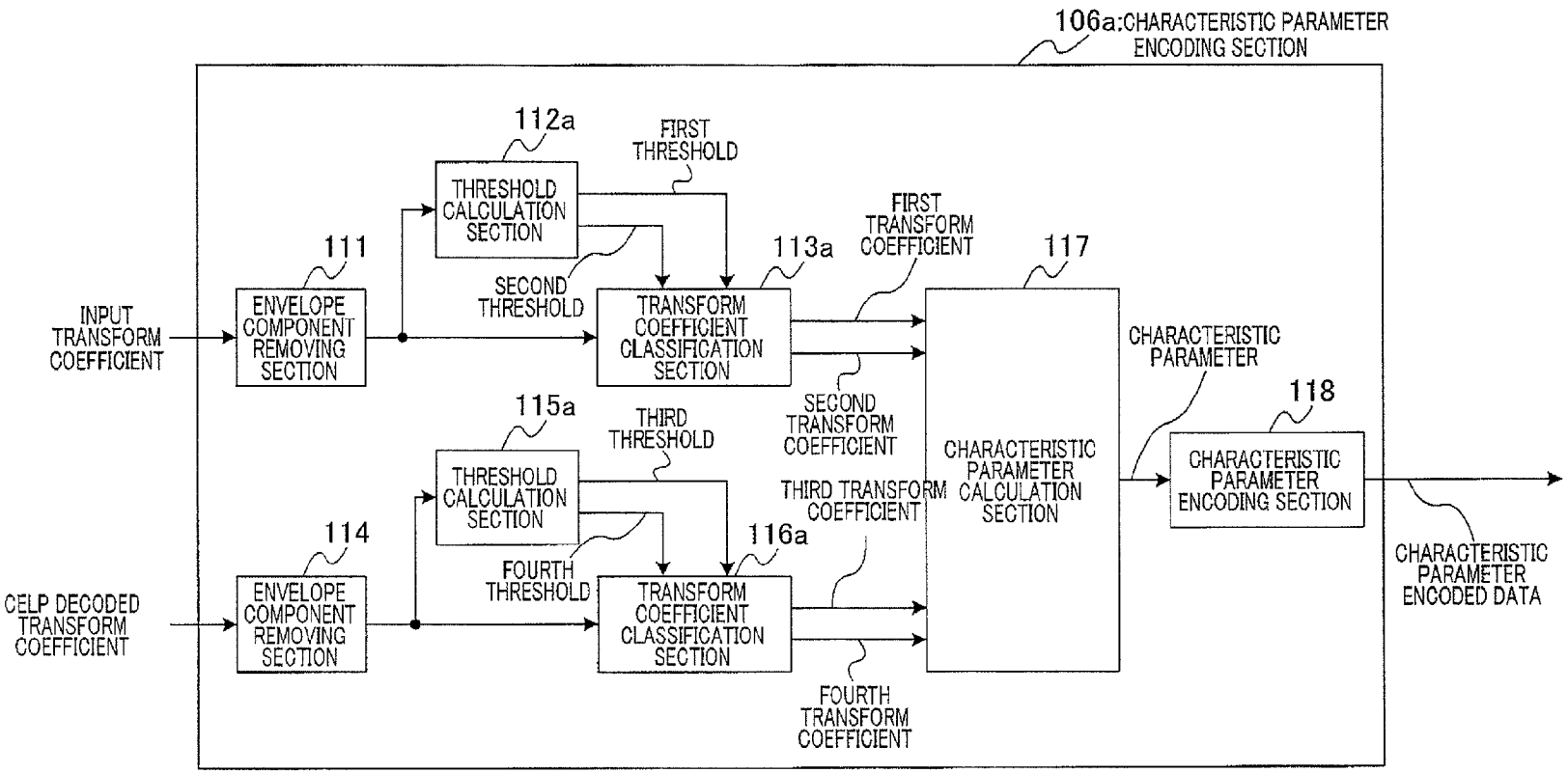
FIG. 11 is a block diagram showing an internal configuration of a characteristic parameter encoding section according to Embodiment 3 of the present invention.

Hereinafter, the present embodiment will be described more specifically. FIG. 11 is a block diagram showing an internal configuration of a characteristic parameter encoding section of encoding apparatus 100 (FIG. 2) according to the present embodiment. In characteristic parameter encoding section 106*a* in FIG. 11, components common to those of characteristic parameter encoding section 106 shown in FIG. 3 will be assigned the same reference numerals as those in FIG. 3 and descriptions thereof will be omitted.

In characteristic parameter encoding section 106*a* shown in FIG. 11, threshold calculation section 112*a* calculates a first threshold to classify the input transform coefficient as peak components (first transform coefficient) and a second threshold to classify the input transform coefficient as floor components (second transform coefficient) using the input transform coefficient after the removal of the envelope component inputted from envelope component removing section 111.

For example, threshold calculation section 112*a* calculates first threshold $Th_1$ and second threshold $Th_2$ using standard deviation σ of the absolute value of the input transform coefficient after the removal of the envelope component as shown in following equations 11 and 12 in the same way as in equation 1.

[11]

$$Th_1=c_1\cdot\sigma \quad \text{(Equation 11)}$$

[12]

$$Th_2=c_2\cdot\sigma \quad \text{(Equation 12)}$$

Here, $c_1$ and $c_2$ represent coefficients to calculate first threshold $Th_1$ and second threshold $Th_2$ and have a relationship shown in following equation 13.

[13]

$$0<c_2<c_1 \quad \text{(Equation 13)}$$

Transform coefficient classification section 113*a* classifies the input transform coefficient after the removal of the envelope component inputted from envelope component removing section 111 into peak components (first transform coefficient) and floor components (second transform coefficient) using first threshold $Th_1$ and second threshold $Th_2$ calculated in threshold calculation section 112*a* and classifies components that belong to neither component as other components, classifying them as neither component. To be more specific, when the absolute value of input transform coefficient $S_R(k)$ after the removal of the envelope component is equal to or above first threshold $Th_1$ (that is, when $|S_R(k)k|\geq Th_1$), transform coefficient classification section 113*a* classifies input transform coefficient $S_R(k)$ as peak components (first transform coefficient). Furthermore, when the absolute value of input transform coefficient $S_R(k)$ after the removal of the envelope component is equal to or less than second threshold $Th_2$ (that is, when $|S_R(k)|\leq Th_2$), transform coefficient classification section 113*a* classifies input transform coefficient $S_R(k)$ as floor components (second transform coefficient). On the other hand, when the absolute value of input transform coefficient $S_R(k)$ after the removal of the envelope component is less than first threshold $Th_1$ and greater than second threshold $Th_2$ (that is, when $Th_2<|_R(k)|<Th_1$), transform coefficient classification section 113*a* classifies input transform coefficient $S_R(k)$ as other components (components belonging to neither peak components nor floor components), classifying it as neither component.

Furthermore, threshold calculation section 115*a* calculates a third threshold to classify peak components (third transform coefficient) of the CELP decoded transform coefficient and a fourth threshold to classify floor components (fourth transform coefficient) of the CELP decoded transform coefficient as in the case of threshold calculation section 112*a*. Furthermore, transform coefficient classification section 116*a* classifies the CELP decoded transform coefficient after the removal of the envelope component into peak components (third transform coefficient) and floor components (fourth transform coefficient) using the third threshold and fourth threshold as in the case of transform coefficient classification section 113*a* and classifies components that belong to neither component as other components, classifying them as neither component.

Figure 12:
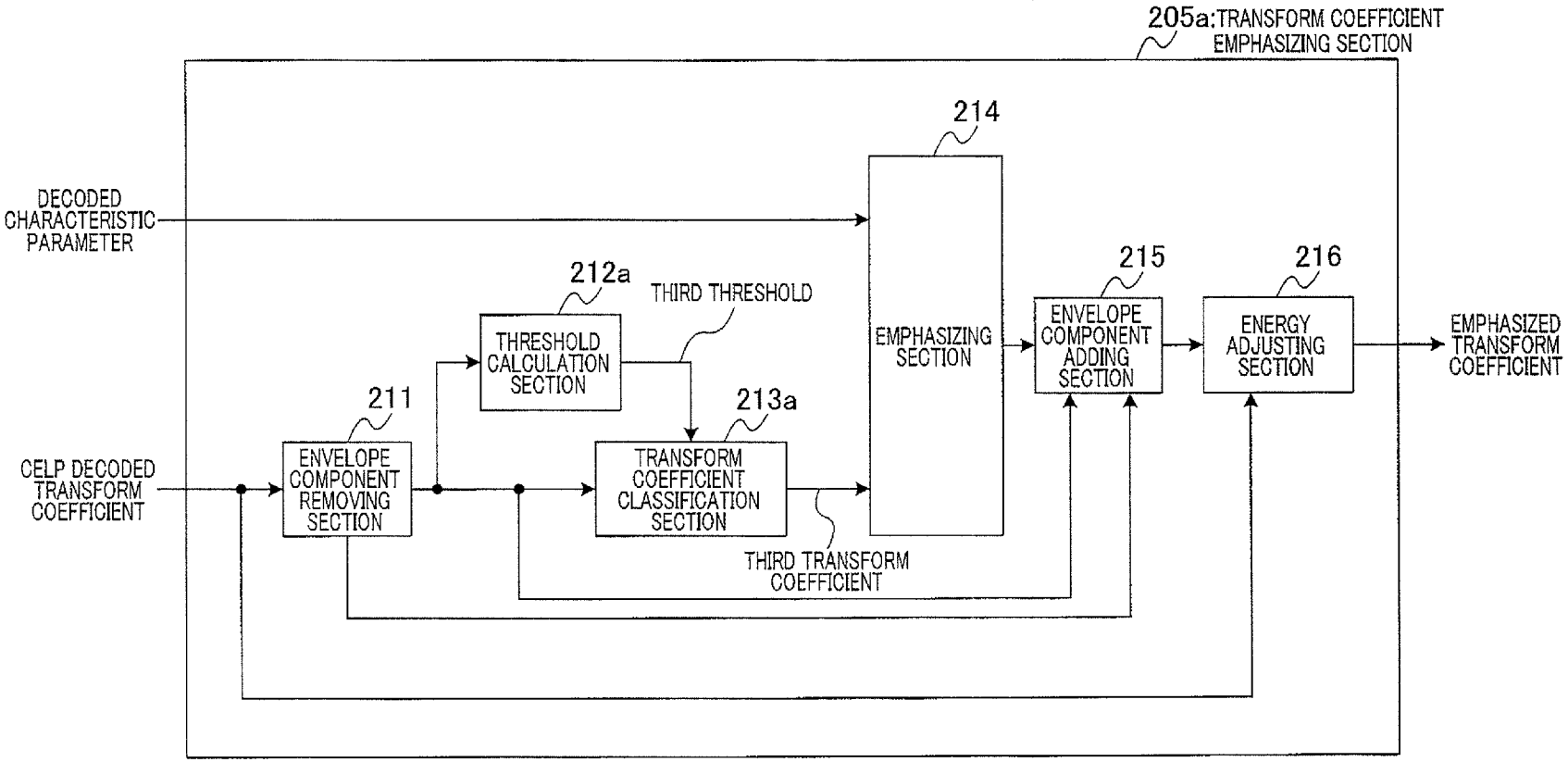
FIG. 12 is a block diagram showing an internal configuration of a transform coefficient emphasizing section according to Embodiment 3 of the present invention.

FIG. 12 is a block diagram showing an internal configuration of a transform coefficient emphasizing section of decoding apparatus 200 (FIG. 4) according to the present embodiment. In transform coefficient emphasizing section 205*a* in FIG. 12, components common to those of transform coefficient emphasizing section 205 shown in FIG. 5 will be assigned the same reference numerals as those in FIG. 5 and descriptions thereof will be omitted.

In transform coefficient emphasizing section 205*a* shown in FIG. 12, threshold calculation section 212*a* calculates the third threshold to classify peak components (third transform coefficient) of the CELP decoded transform coefficient as in the case of threshold calculation section 115*a* (FIG. 11). Furthermore, transform coefficient classification section 213*a* classifies peak components (third transform coefficient) from the CELP decoded transform coefficient using the third threshold inputted from threshold calculation section 212*a* as in the case of transform coefficient classification section 116*a*.

In this way, in the present embodiment, encoding apparatus 100 (characteristic parameter encoding section 106*a*) uses two thresholds, and can thereby calculate a characteristic parameter by excluding components which cannot be clearly judged to belong to which of peak components or floor components (e.g., components that satisfy $Th_2<|S_R(k)|<Th_1$). In this way, encoding apparatus 100 can calculate the ratio of peak components and floor components of the transform coefficient (input transform coefficient or CELP decoded transform coefficient) more accurately than Embodiment 1. That is, encoding apparatus 100 according to the present embodiment can calculate the characteristic parameter more accurately than Embodiment 1 and further improve the sound quality improvement effect on a music signal decoded in decoding apparatus 200.

Thus, when encoding a music signal using CELP encoding, the present embodiment can further improve the quality of a decoded signal compared to Embodiment 1.

Embodiment 4

The present embodiment will describe a case where scalable encoding using CELP encoding for a low layer (or basic layer) and using transform encoding for a high layer (or enhanced layer) is performed.

Figure 13:
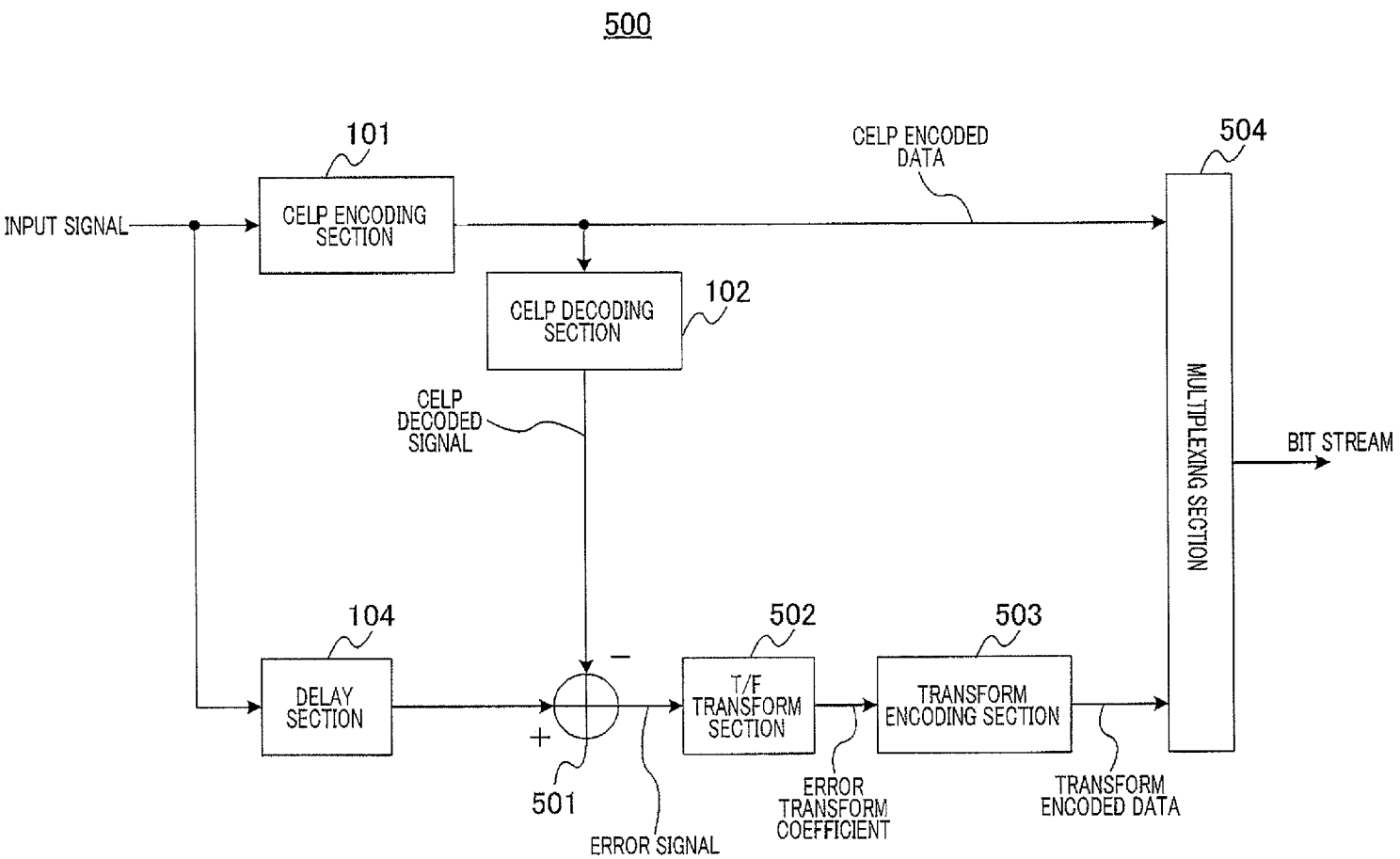
FIG. 13 is a block diagram showing a configuration of an encoding apparatus according to Embodiment 4 of the present invention.

Hereinafter, the present embodiment will be described more specifically. FIG. 13 is a block diagram showing a configuration of main parts of an encoding apparatus according to the present embodiment. In encoding apparatus 500 in FIG. 13, components common to those of encoding apparatus 100 shown in FIG. 2 will be assigned the same reference numerals as those in FIG. 2 and descriptions thereof will be omitted.

Encoding apparatus 500 shown in FIG. 13 is an encoding apparatus that performs scalable encoding having at least a low layer and a high layer. Here, encoding apparatus 500 CELP-encodes an input signal in the low layer to generate CELP encoded data (first encoded data). Furthermore, in a high layer, encoding apparatus 500 encodes (transform-encodes) an error signal which is a difference between a decoded signal of CELP encoded data and an input signal in a frequency domain to generate transform encoded data (second encoded data).

To be more specific, in encoding apparatus 500 in FIG. 13, subtractor 501 subtracts a CELP decoded signal inputted from CELP decoding section 102 from a delay-adjusted input signal inputted from delay section 104 to generate an error signal and outputs the generated error signal to T/F transform section 502.

T/F transform section 502 transforms the error signal inputted from subtractor 501 into a frequency domain signal, calculates an error transform coefficient and outputs the error transform coefficient to transform encoding section 503. Here, MDCT (Modified Discrete Cosine Transform) is used for transforming to the frequency domain.

Transform encoding section 503 performs encoding processing on the error transform coefficient inputted from T/F transform section 502 and generates transform encoded data. At this time, transform encoding section 503 which is an encoding section in a high layer encodes an error signal which is a difference between the CELP decoded signal and the input signal in part of the entire band of the input signal and generates transform encoded data. Transform encoding section 503 outputs the generated transform encoded data to multiplexing section 504.

Multiplexing section 504 multiplexes the CELP encoded data inputted from CELP encoding section 101 and transform encoded data inputted from transform encoding section 503, generates a bit stream and outputs the bit stream to the decoding apparatus via a transmission channel (not shown).

Figure 14:
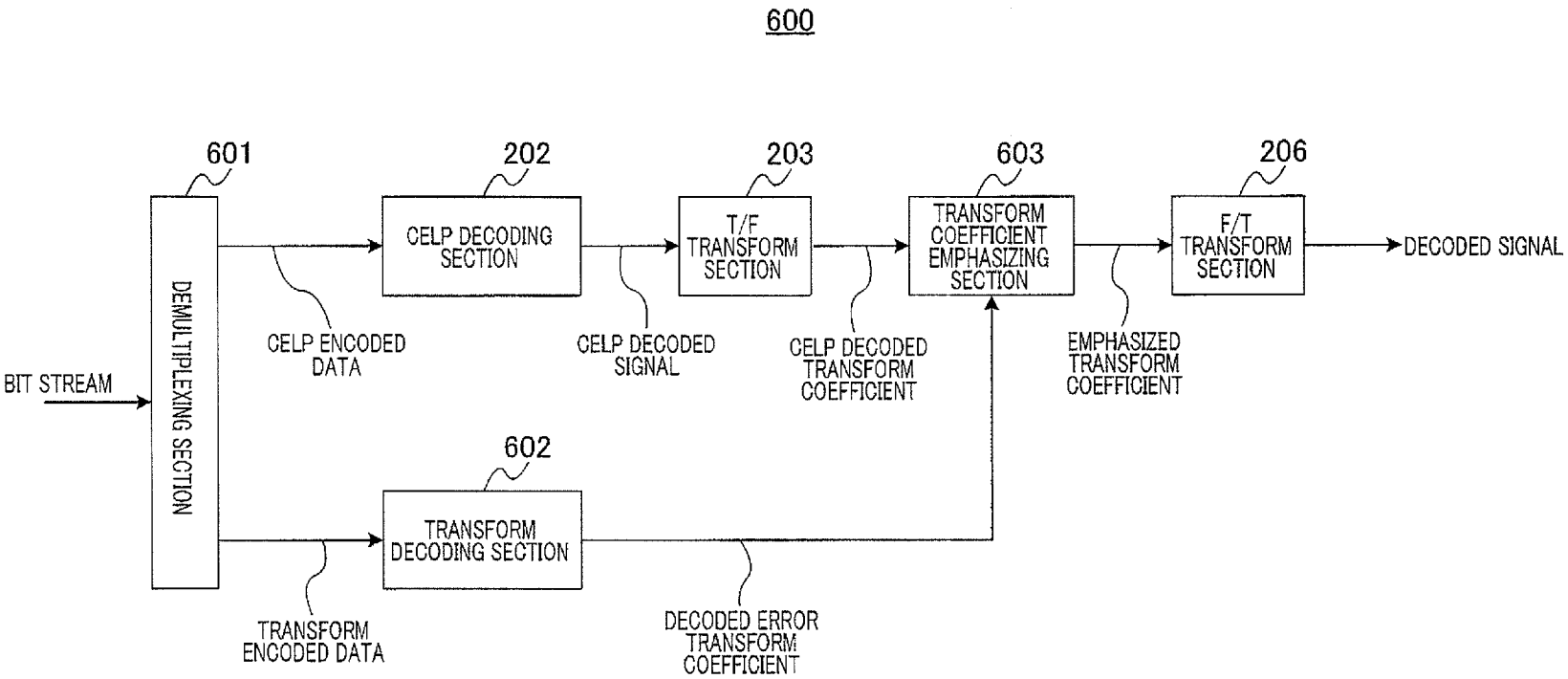
FIG. 14 is a block diagram showing a configuration of a decoding apparatus according to Embodiment 4 of the present invention.

FIG. 14 is a block diagram showing a configuration of main parts of the decoding apparatus according to the present embodiment. In decoding apparatus 600 in FIG. 14, components common to those of decoding apparatus 200 shown in FIG. 4 will be assigned the same reference numerals as those in FIG. 4 and descriptions thereof will be omitted.

In decoding apparatus 600 shown in FIG. 14, demultiplexing section 601 demultiplexes the bit stream inputted via a transmission channel (not shown) into CELP encoded data and transform encoded data. Demultiplexing section 601 outputs the CELP encoded data to CELP decoding section 202 and outputs the transform encoded data to transform decoding section 602.

Transform decoding section 602 performs decoding processing on the transform encoded data inputted from demultiplexing section 601, generates a decoded error transform coefficient and outputs the generated decoded error transform coefficient to transform coefficient emphasizing section 603.

Transform coefficient emphasizing section 603 calculates the amount of improvement of the band with quality improved in a high layer using the CELP decoded transform coefficient inputted from T/F transform section 203 and the decoded error transform coefficient inputted from transform decoding section 602. To be more specific, transform coefficient emphasizing section 603 calculates a characteristic parameter indicating the amount of fluctuation in the ratio of the peak components and the floor components between the spectra of the CELP decoded signal and the decoded transform coefficient obtained using the CELP decoded signal and error signal in part of the band in which the quality of the CELP decoded signal is improved in a high layer. Transform coefficient emphasizing section 603 emphasizes the CELP decoded transform coefficient based on the calculation result of the amount of improvement (that is, characteristic parameter). To be more specific, transform coefficient emphasizing section 603 adjusts the amplitude of peak components of the spectrum of the CELP decoded signal in the band other than the above-described part (band in which the quality of the CELP decoded signal is not improved in the high layer) using the characteristic parameter. Transform coefficient emphasizing section 603 outputs the emphasized CELP decoded transform coefficient to F/T transform section 206 as the emphasized transform coefficient.

Figure 15:
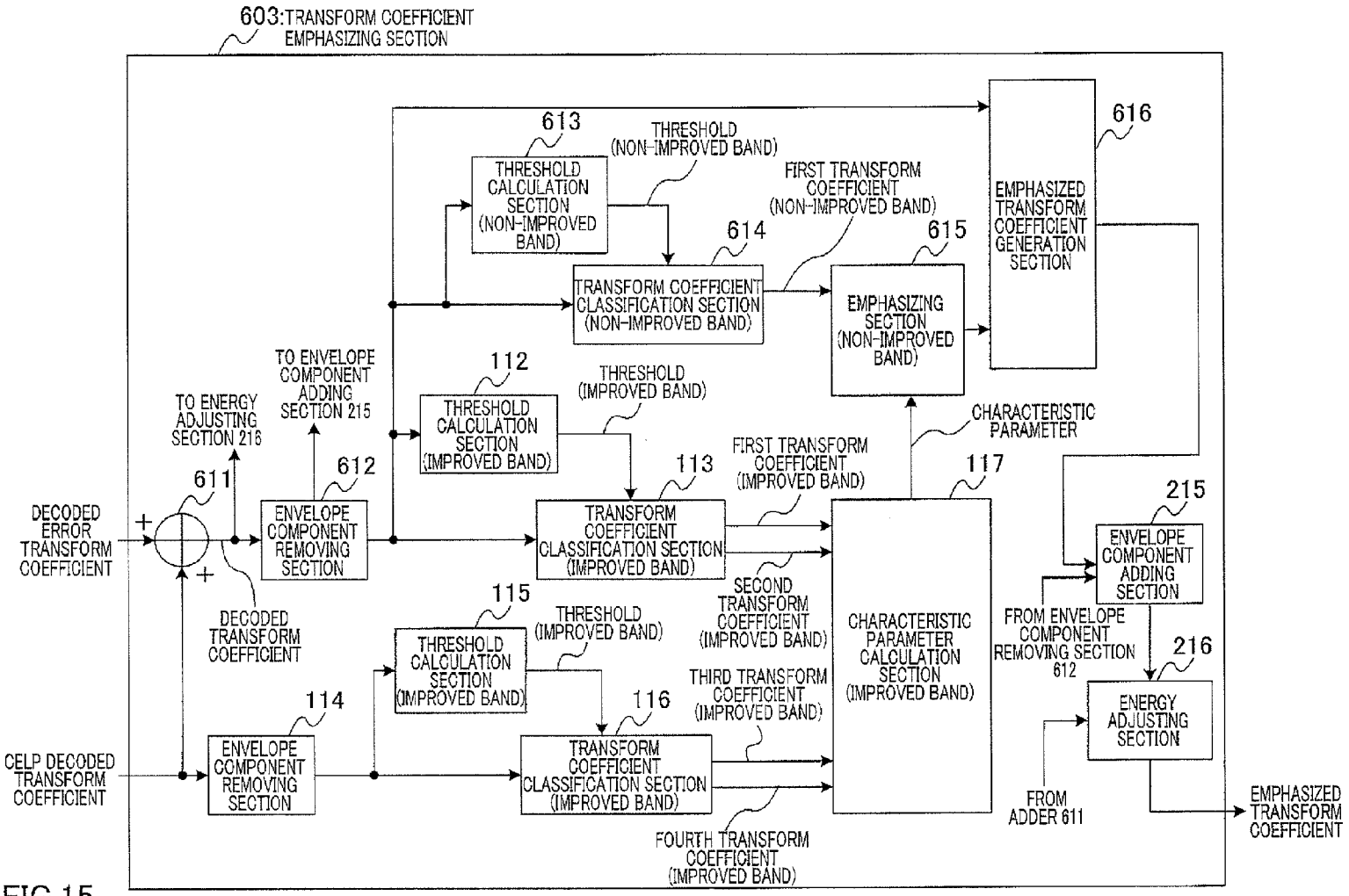
FIG. 15 is a block diagram showing an internal configuration of a transform coefficient emphasizing section according to Embodiment 4 of the present invention.

Next, details of the processing in transform coefficient emphasizing section 603 of decoding apparatus 600 shown in FIG. 14 will be described. FIG. 15 is a block diagram showing an internal configuration of transform coefficient emphasizing section 603. In transform coefficient emphasizing section 603 in FIG. 15, components common to those of characteristic parameter encoding section 106 shown in FIG. 3 and transform coefficient emphasizing section 205 shown in FIG. 5 will be assigned the same reference numerals as those in FIG. 3 and FIG. 5, and descriptions thereof will be omitted.

In transform coefficient emphasizing section 603 shown in FIG. 15, adder 611 adds up the CELP decoded transform coefficient inputted from T/F transform section 203 and the decoded error transform coefficient inputted from transform decoding section 602 to generate a decoded transform coefficient. This decoded transform coefficient corresponds to the input transform coefficient in FIG. 3 (spectrum of the input signal). This addition processing improves the quality of the band corresponding to the decoded error transform coefficient in the CELP decoded transform coefficient. Adder 611 outputs the generated decoded transform coefficient to envelope component removing section 612 and energy adjusting section 216.

Envelope component removing section 612 removes an envelope component (outline component of the spectrum) of the decoded transform coefficient inputted from adder 611 in the same way as in envelope component removing section 111 (FIG. 3). Envelope component removing section 612 outputs the decoded transform coefficient after the removal of the envelope component to emphasized transform coefficient generation section 616. Furthermore, envelope component removing section 612 outputs the decoded transform coefficient after the removal of the envelope component included in a band with quality improved in a high layer (enhanced layer) (hereinafter referred to as "improved band") to threshold calculation section 112 and transform coefficient classification section 113. On the other hand, envelope component removing section 612 outputs the decoded transform coefficient after the removal of the envelope component included in a band with quality not improved in a high layer (enhanced layer) (hereinafter referred to as "non-improved band") to threshold calculation section 613 and transform coefficient classification section 614. A certain value is stored as the decoded error transform coefficient of the band in which the quality of the CELP decoded transform coefficient has been improved in the high layer. Thus, envelope component removing section 612 checks components in each band of the decoded error transform coefficient, and can thereby determine in which band the quality of the CELP decoded transform coefficient has been improved.

Thus, as shown in FIG. 15, characteristic parameter calculation section 117 receives peak components (first transform coefficient (improved band)) and floor components (second transform coefficient (improved band)) of the decoded transform coefficient in the improved band (corresponding to the input transform coefficient in FIG. 3) from transform coefficient classification section 113.

Furthermore, threshold calculation section 115 and transform coefficient classification section 116 receive the CELP decoded transform coefficient after the removal of the envelope component in the improved band. Thus, as shown in FIG. 15, characteristic parameter calculation section 117 receives peak components (third transform coefficient (improved band)) and floor components (fourth transform coefficient (improved band)) of the CELP decoded transform coefficient in the improved band from transform coefficient classification section 116.

Thus, characteristic parameter calculation section 117 calculates a characteristic parameter using the first transform coefficient (improved band), the second transform coefficient (improved band), the third transform coefficient (improved band) and the fourth transform coefficient (improved band) as in the case of Embodiment 1. That is, characteristic parameter calculation section 117 calculates a characteristic parameter indicating the amount of fluctuation in the ratio of the peak components and the floor components between the spectra of the decoded transform coefficient (that is, decoded input signal) obtained using the CELP decoded transform coefficient (that is, CELP decoded signal) and the decoded error transform coefficient (that is, error signal) in the improved band (part of the band of the input signal) and the CELP decoded transform coefficient (CELP decoded signal). Characteristic parameter calculation section 117 outputs the calculated characteristic parameter to emphasizing section 615.

On the other hand, threshold calculation section 613 calculates a threshold corresponding to the decoded transform coefficient included in the non-improved band inputted from envelope component removing section 612 as in the case of threshold calculation section 112. Furthermore, transform coefficient classification section 614 classifies the peak components from the decoded transform coefficient included in the non-improved band using the threshold inputted from threshold calculation section 613 as in the case of transform coefficient classification section 113 and outputs the first transform coefficient (non-improved band) which is the decoded transform coefficient corresponding to the peak components to emphasizing section 615.

Emphasizing section 615 emphasizes the first transform coefficient (non-improved band) inputted from transform coefficient classification section 614 using the characteristic parameter inputted from characteristic parameter calculation section 117. That is, emphasizing section 615 adjusts the amplitude of the peak components of the spectrum (first transform coefficient (non-improved band)) of the CELP decoded signal in the non-improved band which is the part of the band other than the improved band of the entire band of the input signal using the characteristic parameter.

That is, emphasizing section 615 emphasizes the peak components of the spectrum (CELP decoded transform coefficient) of the CELP decoded signal in the non-improved band using the characteristic parameter indicating the amount of fluctuation in the ratio of the peak components and the floor components of the spectrum of the CELP decoded signal in the improved band and the ratio of the peak components and the floor components of the spectrum of the input signal in the improved band (decoded transform coefficient in FIG. 15). Emphasizing section 615 outputs the emphasized first transform coefficient (non-improved band) to emphasized transform coefficient generation section 616.

Emphasized transform coefficient generation section 616 substitutes the emphasized first transform coefficient inputted from emphasizing section 615 (non-improved band) (that is, amplitude-adjusted peak components) for the components included in the non-improved band of the decoded transform coefficient after the removal of the envelope component inputted from envelope component removing section 612 and judged as a peak component, and generates an emphasized transform coefficient.

As in the case of Embodiment 1, envelope component adding section 215 adds an envelope component to the emphasized transform coefficient inputted from emphasized transform coefficient generation section 616 using the envelope component of the decoded transform coefficient inputted from envelope component removing section 612 and energy adjusting section 216 adjusts the energy of the emphasized transform coefficient.

Next, a processing flow of transform coefficient emphasizing section 603 (FIG. 15) will be described in detail using FIG. 16.

To be more specific, adder 611 adds up the CELP decoded transform coefficient and the decoded error transform coefficient shown in FIG. 16A to generate a decoded transform coefficient and envelope component removing section 612 removes the envelope component of the decoded transform coefficient. Transform coefficient emphasizing section 603 checks the value of the decoded error transform coefficient as shown in FIG. 16A, and can thereby decide which of the improved band or non-improved band each frequency band is.

Next, transform coefficient classification section 113 classifies the decoded transform coefficient included in the improved band out of the decoded transform coefficient after the removal of the envelope component shown in FIG. 16B into peak components (first transform coefficient (improved band)) and floor components (second transform coefficient (improved band)) and outputs these components to characteristic parameter calculation section 117. Similarly, transform coefficient classification section 116 classifies the CELP decoded transform coefficient included in the improved band out of the CELP decoded transform coefficient after the removal of the envelope component shown in FIG. 16C into peak components (third transform coefficient (improved band)) and floor components (fourth transform coefficient (improved band)) and outputs these components to characteristic parameter calculation section 117.

Characteristic parameter calculation section 117 calculates a characteristic parameter using the first transform coefficient (improved band) to the fourth transform coefficient (improved band).

On the other hand, transform coefficient classification section 614 classifies the peak components (first transform coefficient (non-improved band)) of the decoded transform coefficient included in the non-improved band out of the decoded transform coefficient after the removal of the envelope component shown in FIG. 16B and outputs the peak components to emphasizing section 615. Emphasizing section 615 then emphasizes the peak components of the decoded transform coefficient included in the non-improved band using the characteristic parameter calculated in characteristic parameter calculation section 117. For example, emphasizing section 615 multiplies the peak components (first transform coefficient (non-improved band)) of the decoded transform coefficient included in the non-improved band by the characteristic parameter, and thereby performs emphasizing processing (amplitude adjustment) as in the case of equation 6 in Embodiment 1.

Emphasized transform coefficient generation section 616 substitutes the first transform coefficient (non-improved band) emphasized in emphasizing section 615 for components included in the non-improved band of the decoded transform coefficient shown in FIG. 16B and corresponding to the peak components, and thereby generates an emphasized transform coefficient shown in FIG. 16D.

Envelope component adding section 215 then adds an envelope component to the emphasized transform coefficient shown in FIG. 16D and energy adjusting section 216 adjusts the energy of the emphasized transform coefficient, and an emphasized transform coefficient shown in FIG. 16E is thereby obtained.

Thus, decoding apparatus 600 controls the ratio of the peak components and the floor components of the CELP decoded signal in the non-improved band using the characteristic parameter indicating the amount of fluctuation (fluctuation in the ratio of peak components and floor components) between the spectra of the CELP decoded signal and the input signal (decoded transform coefficient) in the improved band. That is, decoding apparatus 600 causes the ratio of the peak components and the floor components of the CELP decoded signal in the non-improved band to approximate to the ratio of the peak components and the floor components of the CELP decoded signal in the improved band. This allows decoding apparatus 600 to generate, even in the non-improved band, a CELP decoded signal having the intensity of peak performance similar to the intensity of peak performance of the spectrum of the CELP decoded signal in the improved band.

Here, in scalable encoding, if bits are sufficiently distributed in a high layer, the encoding apparatus can encode the error transform coefficient in the entire band. However, in order to realize a low bit rate, when bits distributed in the high layer are insufficient, there is a constraint that the encoding apparatus can encode the error transform coefficient only in part of the band.

By contrast, the present embodiment focuses attention on the difference in the amount of quality improvement between a band with quality improved in the high layer (improved band) and the rest of the band (non-improved band) and decoding apparatus 600 expresses the amount of improvement of the band with quality improved in the high layer (improved band) as the characteristic parameter. Decoding apparatus 600 then adjusts (emphasizes) the peak performance of the band with quality not improved in the high layer (non-improved band) based on the characteristic parameter.

In the present embodiment, this allows decoding apparatus 600 to calculate the characteristic parameter and eliminates the necessity for transmitting the characteristic parameter from encoding apparatus 500 to decoding apparatus 600. That is, when performing scalable encoding, it is possible to obtain a sound quality improvement effect without increasing the bit rate.

In this way, according to the present embodiment, when scalable encoding having a low layer and a high layer is performed, it is possible to improve the quality of a decoded signal even when encoding a music signal using CELP encoding in the same way as in Embodiment 1.

The embodiments of the present invention have been described so far.

A case has been described in the above embodiments where calculation of a characteristic parameter in the entire band of an input signal, encoding and emphasizing processing on a transform coefficient are performed. However, the present invention is not limited to this, but a configuration may also be adopted in which the entire band of an input signal is divided into a plurality of subbands, and calculation of a characteristic parameter, encoding and emphasizing processing on a transform coefficient are performed in each subband. This allows the decoding apparatus to perform emphasizing processing on the transform coefficient in smaller units and thereby allows the sound quality of a music signal to be further improved.

Furthermore, a case has been described in the above embodiments where when encoding the characteristic parameter and performing emphasizing processing on the transform coefficient, the input transform coefficient (or decoded transform coefficient) and CELP decoded transform coefficient are used as they are. However, when encoding the characteristic parameter and performing emphasizing processing on the transform coefficient, the present invention may also use an input transform coefficient and CELP decoded transform coefficient after smoothing processing such as moving average instead of using the input transform coefficient and CELP decoded transform coefficient as they are. When encoding the characteristic parameter and performing emphasizing processing on the transform coefficient for the input transform coefficient and CELP decoded transform coefficient, this makes it possible to reduce influences from an extremely large transform coefficient and perform more stable encoding processing and emphasizing processing. This makes it possible to further improve sound quality of music signals.

Furthermore, the T/F transform section according to the above embodiments can use a DFT (Discrete Fourier Transform), FFT (Fast Fourier Transform), DCT (Discrete Cosine Transform), MDCT (Modified Discrete Cosine Transform), filter bank or the like.

Also, although cases have been described with the above embodiments as examples where the present invention is configured by hardware, the present invention can also be implemented by software.

Each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2010-006260, filed on Jan. 14, 2010, including the specification, drawings and abstract is incorporated herein by reference in its entirety.

INDUSTRIAL APPLICABILITY

The encoding apparatus, decoding apparatus, spectrum fluctuation calculation method and spectrum amplitude adjustment method or the like according to the present invention are suitable for use in codec of speech or music in particular.

REFERENCE SIGNS LIST

100, 300, 500 encoding apparatus
200, 400, 600 decoding apparatus
101 CELP encoding section
102, 202, 301, 401 CELP decoding section
103, 105, 203, 502 T/F transform section
104 delay section
106, 106*a*, 302 characteristic parameter encoding section
107, 504 multiplexing section
201, 601 demultiplexing section
204 characteristic parameter decoding section
205, 205*a*, 402, 603 transform coefficient emphasizing section
206 F/T transform section
111, 114, 211, 612 envelope component removing section
112, 112*a*, 115, 115*a*, 212, 212*a*, 311, 312, 411, 613 threshold calculation section
113, 113*a*, 116, 116*a*, 213, 213*a*, 614 transform coefficient classification section
117 characteristic parameter calculation section
118 characteristic parameter encoding section
214, 615 emphasizing section
215 envelope component adding section
216 energy adjusting section
501 subtractor
503 transform encoding section
602 transform decoding section
611 adder
616 emphasized transform coefficient generation section

The invention claimed is:

1. An encoding apparatus, comprising:

a first encoder that performs code excited linear prediction (CELP) encoding on an input signal to generate first encoded data;

a decoder that performs CELP decoding on the first encoded data to generate a CELP decoded signal;

a second encoder that calculates a parameter indicating an amount of fluctuation between a first ratio and a second ratio, and encodes the parameter to generate second encoded data, the first ratio being a ratio between peak components and floor components of spectra of the CELP decoded signal and the second ratio being a ratio between peak components and floor components of spectra of the input signal; and a multiplexing section that multiplexes and outputs the first encoded data and the second encoded data.

2. A decoding apparatus, comprising:

a demultiplexer that receives and demultiplexes the first encoded data and the second encoded data from the encoding apparatus according to claim 1;

a first decoder that decodes the first encoded data to generate the CELP decoded signal;

a second decoder that decodes the second encoded data to generate the parameter; and an adjuster that adjusts amplitude of peak components of a spectrum of the CELP decoded signal using the parameter.

3. A decoding apparatus, comprising:

a demultiplexer that receives and demultiplexes first encoded data and second encoded data from an encoding apparatus that performs scalable encoding having at least a low layer and a high layer, the first encoded data being generated by performing code excited linear prediction (CELP) encoding on an input signal in the low layer, and the second encoded data being generated by encoding an error signal which is a difference between a CELP decoded signal and the input signal the CELP decoded signal being obtained by decoding the first encoded data in part of the band of the input signal in the high layer;

a first decoder that decodes the first encoding data to generate a CELP decoded signal;

a second decoder that decodes the second encoded data to obtain the error signal, and an adjuster that adjusts amplitude of peak components of a spectrum of the CELP decoded signal in the band other than the part of the band using a parameter indicating an amount of fluctuation between a first ratio and a second ratio, the first ratio being a ratio between peak components and floor components of spectra of the CELP decoded signal, and the second ration being a ratio between peak components and floor components in the part of a decoded input signal obtained by using the CELP decoded signal and the error signal.

4. An encoding method, comprising:

performing code excited linear prediction (CELP) encoding on an input signal to generate first encoded data;

decoding the first encoded data to generate a CELP decoded signal;

calculating a parameter indicating an amount of fluctuation between a first ratio and a second ratio, and encoding the parameter to generate second encoding data, the first ratio being a ratio between peak components and floor components of spectra of the CELP decoded signal and the second ratio being a ratio between peak components and floor components of spectra of the input signal; and multiplexing and outputting the first encoded data and the second encoded data.

5. A decoding spectrum amplitude adjustment method, comprising:

receiving and demultiplexing the first encoded data and the second encoded data that are encoded by the encoding method according to claim 4;

decoding the first encoded data to generate the CELP decoded signal;

decoding the second encoded data to generate the parameter; and adjusting amplitude of peak components of a spectrum of the CELP decoded signal using the parameter.

6. The encoding apparatus according to claim 1, wherein the second encoder determines the peak components and the floor components using a pitch gain in the CELP encoding.

* * * * *